US008215985B2

(12) United States Patent
Amidon et al.

(10) Patent No.: US 8,215,985 B2
(45) **Date of Patent: *Jul. 10, 2012**

(54) STEP UP PIN FOR COAX CABLE CONNECTOR

(75) Inventors: Jeremy Amidon, Marcellus, NY (US); Noah Montena, Syracuse, NY (US); Chris Natoli, Fulton, NY (US)

(73) Assignee: John Mezzalingua Associates, East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,701

(22) Filed: May 24, 2011

(65) Prior Publication Data

US 2011/0223804 A1 Sep. 15, 2011

Related U.S. Application Data

(60) Continuation of application No. 12/685,286, filed on Jan. 11, 2010, now Pat. No. 7,946,885, and a continuation-in-part of application No. 12/059,313, filed on Mar. 31, 2008, now Pat. No. 7,645,163, and a continuation-in-part of application No. 12/055,486, filed on Mar. 26, 2008, now Pat. No. 7,513,796, and a division of application No. 11/520,346, filed on Sep. 13, 2006, now Pat. No. 7,351,099.

(51) Int. Cl.
*H01R 9/05* (2006.01)

(52) U.S. Cl. ..... 439/578

(58) Field of Classification Search ..... 439/578, 439/583–585, 501

See application file for complete search history.

(56) References Cited

U.S. PATENT DOCUMENTS

| | | | |
|---|---|---|---|
| 3,213,404 | A | 10/1965 | Hedstrom |
| 4,613,199 | A | 9/1986 | McGeary |
| 4,666,230 | A | 5/1987 | Gartzke |
| 4,672,342 | A | 6/1987 | Gartzke |
| 4,676,577 | A | 6/1987 | Szegda |
| 4,923,412 | A | 5/1990 | Morris |
| 4,957,454 | A | 9/1990 | Shichida |
| 4,981,445 | A | 1/1991 | Bacher et al. |
| 5,137,471 | A | 8/1992 | Verespej et al. |
| 5,217,391 | A | 6/1993 | Fisher, Jr. |
| 5,498,175 | A | 3/1996 | Yeh et al. |
| 5,769,662 | A | 6/1998 | Stabile et al. |
| 5,957,724 | A | 9/1999 | Lester |
| 6,159,046 | A | 12/2000 | Wong |

(Continued)

FOREIGN PATENT DOCUMENTS

FR 2570227 A1 3/1986

(Continued)

OTHER PUBLICATIONS

Notice of Allowance (Mail Date Jan. 14, 2011) for U.S. Appl. No. 12/685,286, filed Jan. 11, 2010; Confirmation No. 7087.

(Continued)

*Primary Examiner* — Tho D Ta

(74) *Attorney, Agent, or Firm* — Schmeiser Olsen & Watts

(57) ABSTRACT

A coaxial cable connector includes a step up pin that engages the center conductor of a coax cable to increase the diameter of the center conductor to thereby make it more manageable. The pin is stored with the connector until the pin and connector are affixed to a coax cable.

9 Claims, 27 Drawing Sheets

U.S. PATENT DOCUMENTS

| | | | | |
|---|---|---|---|---|
| 6,863,565 | B1 | 3/2005 | Kogan et al. | |
| 7,053,750 | B2 | 5/2006 | Dascher | |
| 7,144,272 | B1 | 12/2006 | Burris et al. | |
| 7,153,159 | B2 | 12/2006 | Burris et al. | |
| 7,351,099 | B1 | 4/2008 | Amidon | |
| 7,513,796 | B2 | 4/2009 | Amidon | |
| 7,645,163 | B2 | 1/2010 | Amidon | |
| 7,946,885 | B2 * | 5/2011 | Amidon et al. | 439/578 |
| 2002/0182934 | A1 | 12/2002 | Endo et al. | |
| 2003/0143887 | A1 | 7/2003 | Rehmann et al. | |
| 2005/0176292 | A1 | 8/2005 | Lee et al. | |
| 2005/0233636 | A1 | 10/2005 | Rodrigues et al. | |
| 2005/0277330 | A1 | 12/2005 | Kisling et al. | |
| 2006/0014425 | A1 | 1/2006 | Montena | |
| 2006/0030209 | A1 | 2/2006 | Higgins | |
| 2006/0142730 | A1 | 6/2006 | Proulx et al. | |
| 2008/0182451 | A1 | 7/2008 | Amidon | |
| 2010/0136827 | A1 | 6/2010 | Chawgo | |

FOREIGN PATENT DOCUMENTS

| | | | |
|---|---|---|---|
| GB | 2264400 | A | 8/1993 |

OTHER PUBLICATIONS

Office Action (Mail Date Jul. 23, 2010) for U.S. Appl. No. 12/685,286, filed Jan. 11, 2010; Confirmation No. 7087.

* cited by examiner

STEP UP PIN FOR COAX CABLE CONNECTOR

CROSS-REFERENCE TO RELATED APPLICATIONS

This application is a continuation patent application of U.S. Ser. No. 12/685,286, filed Jan. 11, 2010, which is a continuation-in-part patent application of U.S. Ser. No. 12/059,313, filed Mar. 31, 2008, now U.S. Pat. No. 7,645,163; which is a continuation-in-part application of U.S. Ser. No. 12/055,486 filed Mar. 26, 2008, now U.S. Pat. No. 7,513,796; which is a divisional application of U.S. Ser. No. 11/520,346, filed Sep. 13, 2006, now U.S. Pat. No. 7,351,099; pursuant to 35 U.S.C. §120, the entire disclosures of each above application/patent being herein incorporated by reference.

FIELD OF INVENTION

This application generally relates to the field of coaxial cable connectors that engage the center conductor and the outer conductor of an end of a coaxial cable and more specifically to a step up pin used in connection with a coaxial cable end and various means for storing the step up pin on a coaxial cable connector.

BACKGROUND OF INVENTION

A coaxial cable connector is generally used to provide a simple connection to an externally threaded coax receptacle or jack. The connector contacts the outer conductor of the cable in order to conduct the outer conductor signal to the jack. The center conductor of the cable passes through the center of the connector to engage the center hole of the jack. A dielectric portion between the components of the connector that contact the center conductor and the outer conductor isolates the signals. In some cases, such as with miniature coaxial cable, the center conductor is too small to engage the center hole of the jack fully for good conduction of the center conductor signal. A "step up" pin may be applied to the end of the center conductor in order to increase the diameter of the center conductor; however, step up pins are conventionally difficult to manage, are easily lost, and may be difficult to apply to the center conductor. Further, step up pins tend to be easily damaged during handling. In some cases, the pin might be a fixed part of the connector. It is difficult to align the center conductor of the coax cable with the step up pin in this case because the user cannot see the opening of the axial bore of the pin.

A number of U.S. patents are directed to coax cable connectors, including U.S. Pat. No. 4,613,199 issued to McGeary. McGeary teaches a coaxial cable connector having a captive inner pin contact. The connector includes a tubular main body that is crimped over the cable braid of a coaxial cable. A crimp ring is provided inside the rear end of the tubular main body and secures the cable braid of the coaxial cable against a ferrule which is inserted between the cable braid and the cable dielectric prior to crimping. A cylindrical contact insulator is secured inside the front end of the tubular main body, separates the inner pin contact from the front end of the tubular main body, and secures the inner pin contact in combination with the insulator ring and ferrule. Threads are provided on the inside surface of the ferrule to hold the ferrule in position during crimping, to help provide positive contact to the tubular main body, and to captivate the insulator ring and inner pin contact. McGeary does not teach how the pin might be stored prior to assembly of the connector onto a cable. McGeary also fails to teach a step up pin having tabs or spring fingers for engaging the connector or the center conductor.

U.S. Pat. No. 6,863,565 issued to Kogan, et al. teaches a connector for receiving a mating plug, forming a constant impedance connection. The center conductor of the first plug is supported with a cap attached over a portion of the center conductor that extends beyond the outer conductor portion of the same plug. The mating plug has an outer conductor that projects beyond the inner conductor, and is made to receive the connector or first plug portions. Kogan thus teaches a pin having a larger diameter than the center conductor and supporting the center conductor. Kogan does not discuss securing the pin to the connector prior to assembly in a way that prevents the pin from being lost and that aids assembly of the pin onto the center conductor. Kogan further does not teach a step up pin with an enlarged cable guide portion or spring fingers and tabs for engaging the center conductor or the connector.

U.S. Pat. No. 4,981,445 issued to Bacher, et al. teaches a unitary three-vane support bead with a central conductor having an axial blind bore in each end. The smaller diameter end engages a center conductor of a coax cable. The central conductor is formed in place in the connector. Bacher does not teach a method of securing the pin to the connector prior to assembly in a way that prevents the pin from being lost and that aids assembly of the pin onto the center conductor.

U.S. Pat. No. 4,672,342 issued to Gartzke teaches a coaxial cable connector assembly for connecting coaxial cables of different diameters, the assembly including a center conductor with a large diameter end and a small diameter end. Each end includes spring fingers for engaging the center conductor of a coaxial cable. Gartzke does not discuss securing the pin to the connector prior to assembly in a way that prevents the pin from being lost and that aids assembly of the pin onto the center conductor.

Therefore, a coaxial cable connector that provides storage and protection for a step up pin, and that provides a simple way to apply the step up pin to the center conductor of a retained coaxial cable is desired.

SUMMARY OF INVENTION

More particularly and according to one aspect, a coaxial cable connector is provided, the connector comprising a body section having an axial bore disposed therethrough, a nut engaging one end of the body section, each of the nut body and said body section being disposed along a center axis extending through the axial bore, and a step up pin mounted for storage in relation to said center axis of said connector so as not to cross or intersect said axis.

In one version, a portion of the connector includes a sidewall bore that is sized for storing the step up pin prior to its use, the sidewall bore being disposed, such as tangentially, so as not to extend through the center axis. The connector can include a compression member attached to the body section oppositely from the nut wherein the sidewall bore can be provided in at least one of the body section, compression member and nut.

In another version, the step up pin can be retained in a radial projection provided on one of the compression member, body section and nut wherein the radial projection includes an axial bore extending substantially parallel to the center axis of the connector.

Alternatively, the step up pin can be retained by a separate ring-like member that is axially mounted in relation to the connector, which includes the radial projection. The step up pin can be releasably attached in a bore sized for retaining at least a portion of the step up pin for storage thereof prior to use.

According to yet another aspect, there is provided a coaxial cable connector comprising a body portion, a nut attached to one end of said body portion, a compression member attached to an opposite end of said connector body portion, each of said connector body portion, said nut and said compression member being disposed and aligned along a center axis of said connector. A step up pin retaining member is releasably attachable to one of the nut and compression member, the pin retaining member including a center aperture sized for retaining a portion of a step up pin.

The pin retaining member according to one version is a cap-like section that is disposed within at least one of the open end of the nut or the open end of compression member of the connector. The pin retaining member according to this version is defined by a body and an extending sleeve or engagement portion that is sized to be fitted into the corresponding end of the connector. According to one version, the cap-like section can be releasably fitted into the open end of nut or the open end of the compression member of the connector.

Advantageously, the herein described invention allows the step up pin to be stored with the connector so that the pin is not easily dropped or lost and such that the pin is easily attached to even small diameter center conductors. Further, because the pin is not fixed within the body of the connector with the opening of the pin hidden within the connector, the user can easily see the opening of the pin for lining up the center conductor.

Another advantage provided is that the positioning of the step up pin does not interfere with the manufacture or use of connectors incorporating same. The storage and use is cost effective and efficient.

These and other features and advantages will be readily apparent from the following Detailed Description, which should be read in conjunction with the accompanying drawings.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the present invention, but should not be construed as limiting the scope of the invention in any manner.

DETAILED DESCRIPTION

Described herein is a coaxial cable connector having a step up pin for increasing the diameter of a coaxial cable's center conductor. Generally, the step up pin includes a blind bore which is sized for a tight fit with the center conductor to provide good conduction between the center conductor and the pin. The step up pin further includes an enlarged cable guide. The pin is stored with the connector until the pin and connector are affixed to a coax cable.

Figure 1:
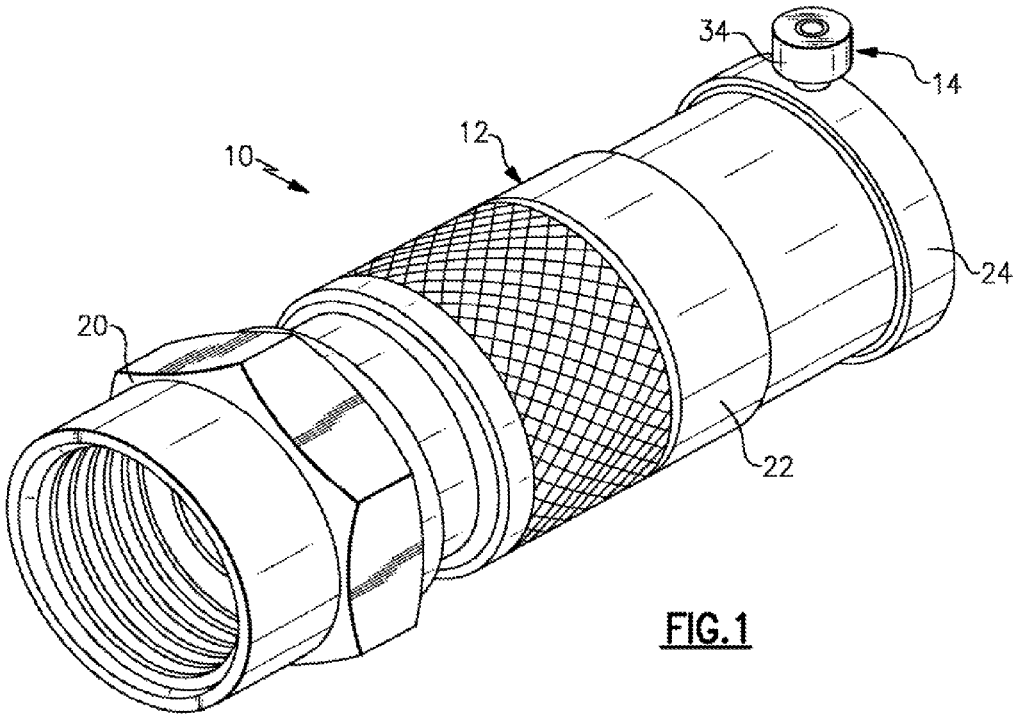
FIG. 1 is an isometric view of a coax cable connector according to an exemplary embodiment of the present invention.
Figure 2:
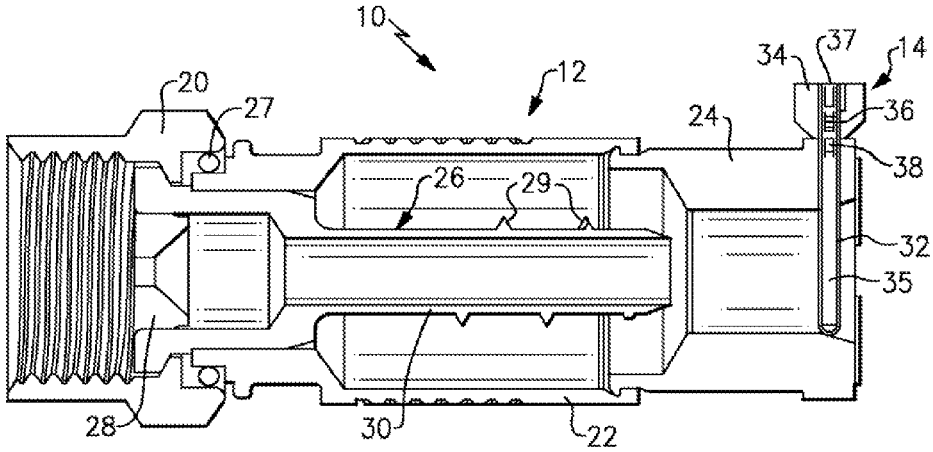
FIG. 2 is a cross-sectional view of the coax cable connector of FIG. 1.

FIG. 1 shows an exemplary coaxial cable connector for purposes of describing the present invention. The coaxial cable connector 10 includes a connector body 12 and a step up pin 14. The connector body 12 as defined herein includes a nut body 20, a body or collar 22, a compression ring 24, and an inner post 26 (see FIG. 2). The nut body 20 includes internal threads for connection to an externally threaded coax jack (not shown). The nut body 20 contacts the inner post 26 for electrical connection and engages one end of the collar 22 via an o-ring 27. The collar 22 is knurled or otherwise textured to provide an improved grip. In its pre-use or storage position, the compression ring 24 is clipped into the end of the collar 22 as shown in FIG. 2. The inner post 26 includes a pin guide 28 and a shaft 30 with barbs 29 for engaging the coax cable's dielectric sleeve.

Figure 3A:
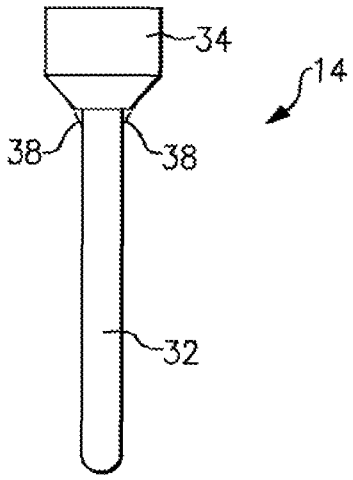
FIGS. 3A-3C are views of the step up pin according to the present invention.
Figure 3B:
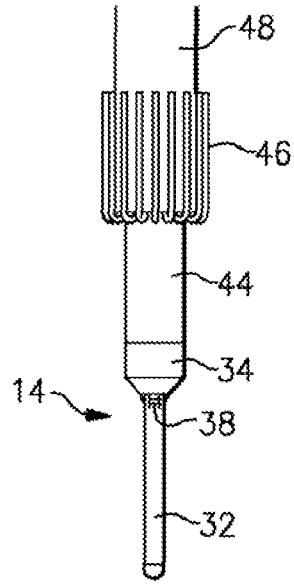
Figure 3C:
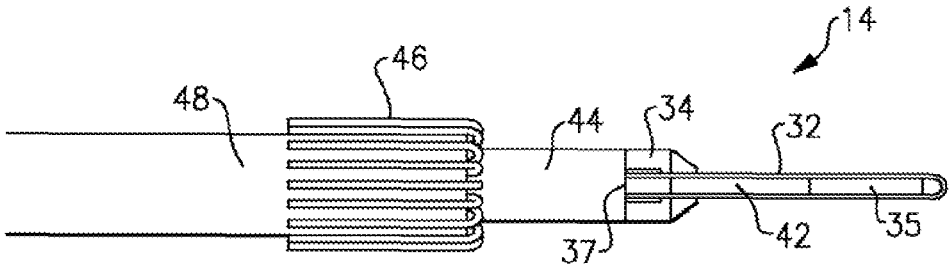

The step up pin 14, which may be used in conjunction with the connector 10 or with any application requiring the increased diameter of the center conductor of a coax cable, includes a pin body 32 and a cable guide 34. The pin body 32, best shown in FIGS. 2 and 3A, includes an axial bore 35 sized for a snug fit with the center conductor of a coax cable. As shown, the axial bore 35 is a blind bore with an open end 37. Spring fingers 36 may be included to secure the center conductor within the bore 35 and to improve the conduction between the center conductor and the step up pin 14. The spring fingers 36 project into the pin body 32 and are directed away from the open end 37. Tabs 38 project outward from the pin body 32, toward the open end 37. The cable guide 34 is either integrally formed with the pin body 32 or affixed thereto, such as by an interference fit or an adhesive. The cable guide 34 fits within the pin guide 28, each of the cable guide and pin guide having sloped surfaces that are engaged with one another when the cable end in finally assembled to the connector, as described in greater detail below. The outward bias of the tabs 38 assists in retaining the step up pin 14 within the pin guide 28. The step up pin 14 is applied to a coax cable 40 as shown in FIGS. 3A-3C.

Figure 4A:
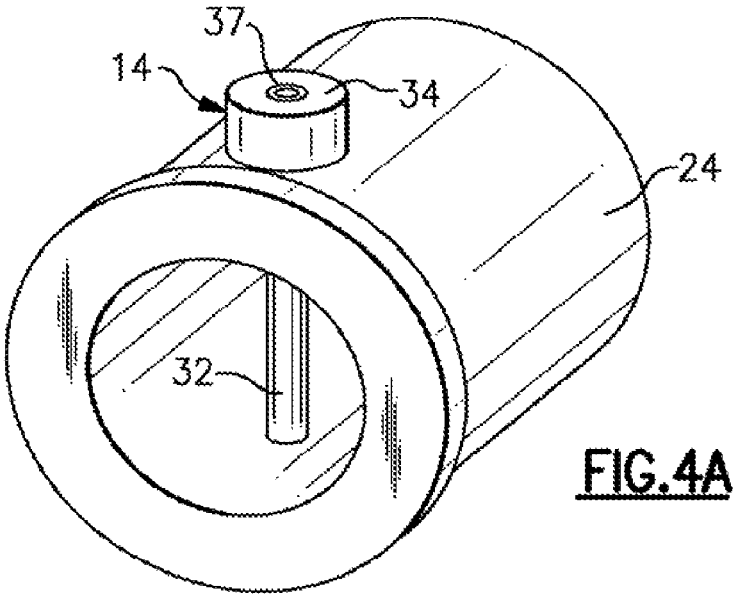
FIG. 4A is an isometric view of the compression ring and step up pin of FIG. 1.
Figure 4B:
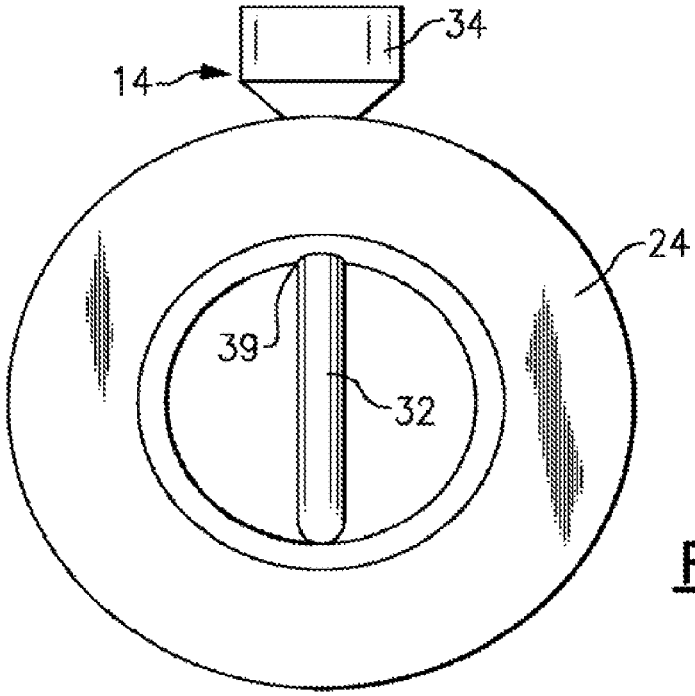
FIG. 4B is an end view of the compression ring and step up pin of FIG. 4A.

As shown in FIGS. 4A and 4B, a sidewall bore 39 is either machined or molded into the compression ring 24 for the storage of the step up pin 14 prior to assembly. The sidewall bore 39 is configured for a snug fit with the pin body 32 to prevent the pin 14 from being separated from the connector body 12. Also, the outward bias of the tabs 38 resists separation of the step up pin 14 and the sidewall bore 39.

Figure 5A:
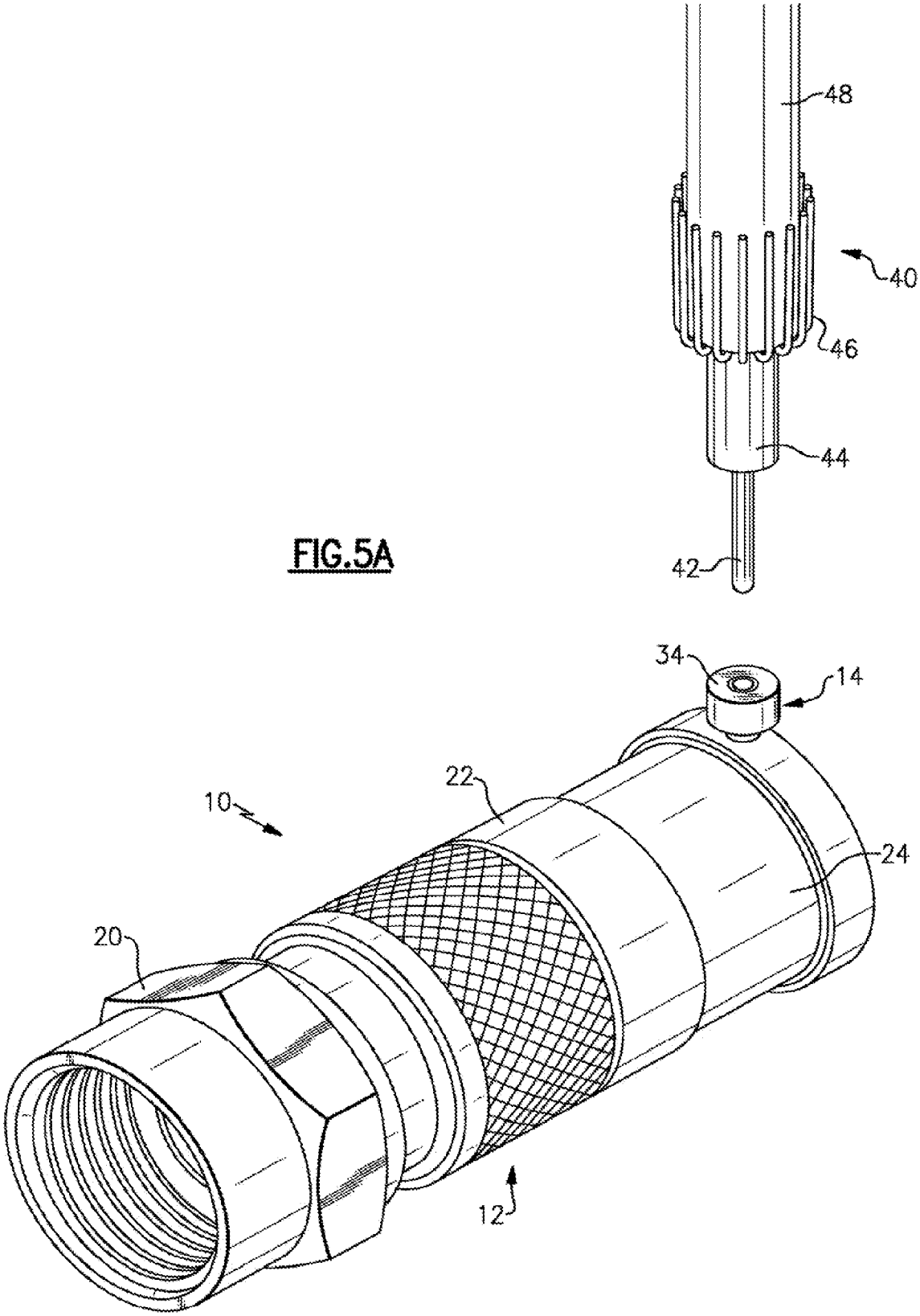
FIGS. 5A-5E are various views of the application of the step up pin and the coax cable connector of FIG. 1 onto a coax cable.
Figure 5B:
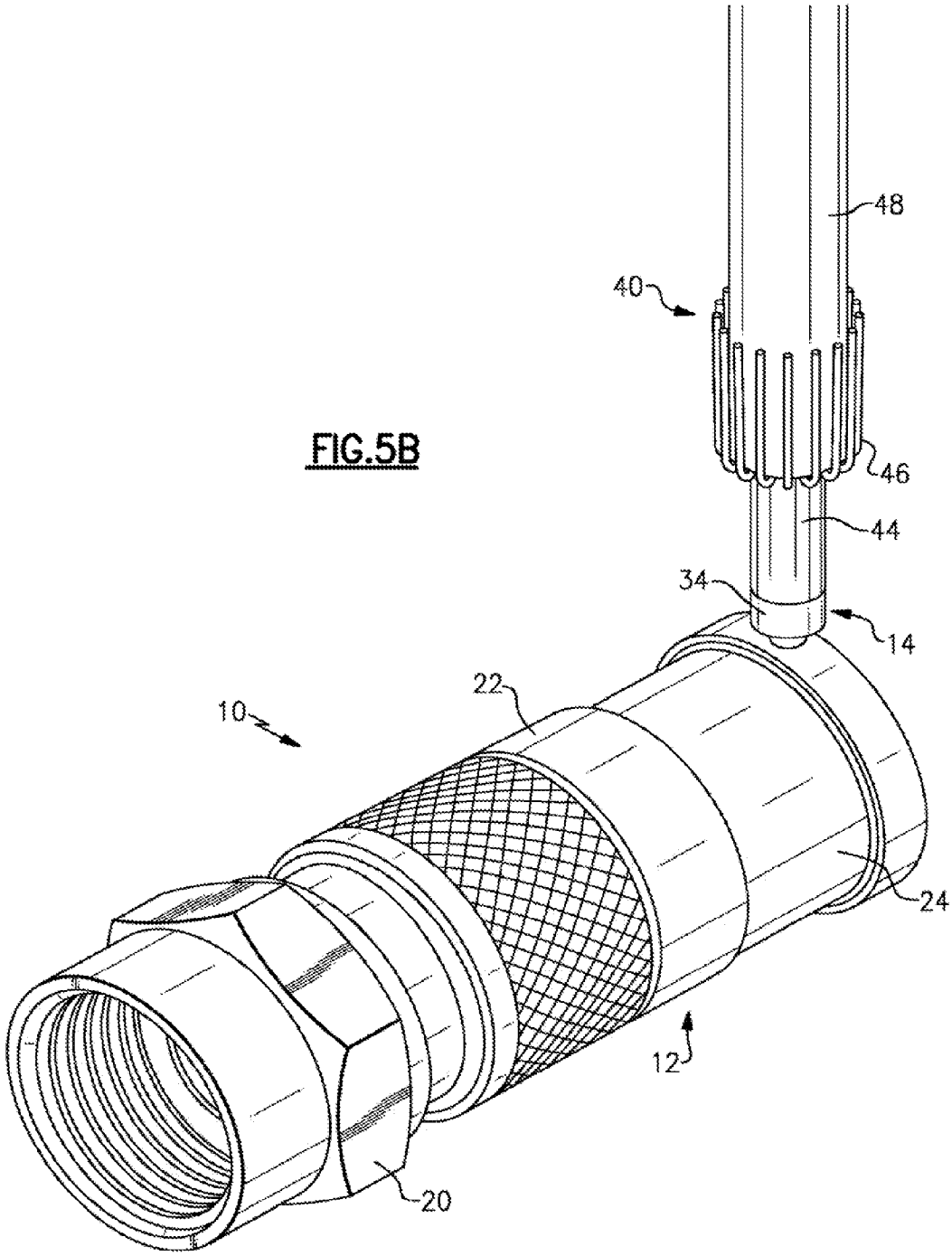
Figure 5C:
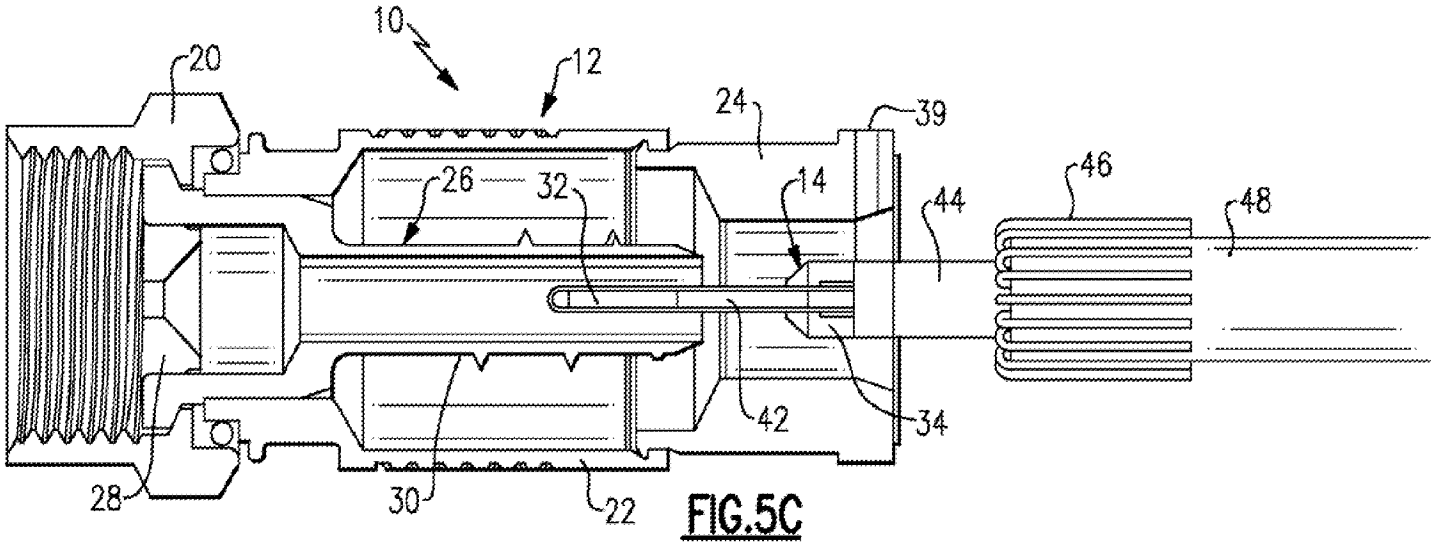

The connector 10 is assembled onto a coax cable 40 as shown in FIGS. 5A-5E. With reference to FIG. 5A, the coax cable 40 is of a known type comprising an electrical central conductor 42, a dielectric sleeve 44, an outer conductor 46, and a jacket 48. The outer conductor 46 may comprise a sheath of fine braided metallic strands, a metallic foil, or multiple layer combinations of either or both. The cable 40 is prepared as usual, such as by exposing an axial section (e.g., about 0.25-inches) of the center conductor 42 and an axial section (e.g., about 0.25-inches) of the dielectric sleeve 44 and outer conductor 46 above that. The outer conductor 46 is folded back over the jacket 48. The user inserts the center conductor 42 into the axial bore 35 of the pin body 32 as shown in FIG. 5B. The user then withdraws the coax cable 40 with the step up pin 14 from the sidewall bore 39 of the compression ring 24 and inserts the cable 40 and step up pin 14 into an axial bore of the compression ring 24, as shown in FIG. 5C.

Figure 5D:
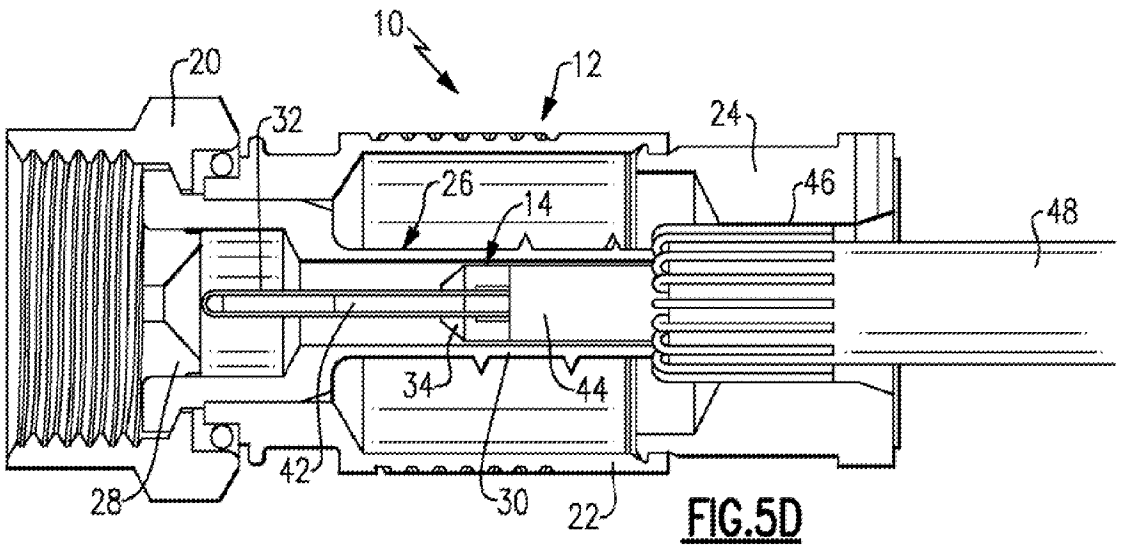
Figure 5E:
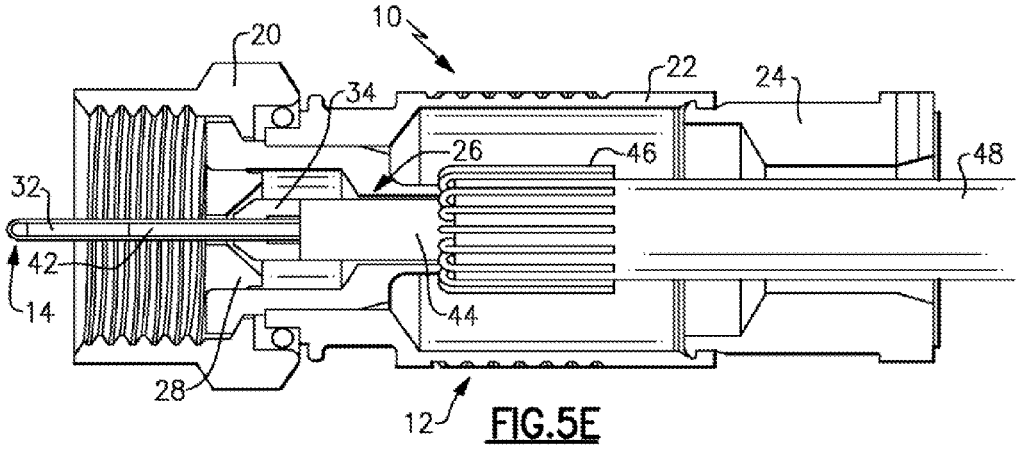

The step up pin 14 and the dielectric sleeve 44 are inserted into an axial bore of the inner post 26 such that the shaft 30 is forced in between the dielectric sleeve 44 and the outer conductor 46 as shown in FIG. 5D. The user continues to direct the cable 40 into the connector body 12 until the cable guide 34 engages the pin guide 28 as shown in FIG. 5E. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

In use, the connector 10 is attached to a coaxial cable jack (not shown) by inserting the step up pin 14 into an axial bore of the jack and threading the internal threads of the nut body 20 onto corresponding external threads of the jack. An electrical signal is conducted between the center conductor of the jack and the center conductor 42 via the pin body 32. An electrical signal is conducted from the threaded outer conductor of the jack to the nut body 20 and the end of the inner post 26. The inner post 26 conducts the signal to the outer conductor 46. The non-conducting pin guide 28 isolates the inner conductor signal from the outer conductor signal within the connector 10. The cable guide 34 may also be non-conducting.

Figure 6A:
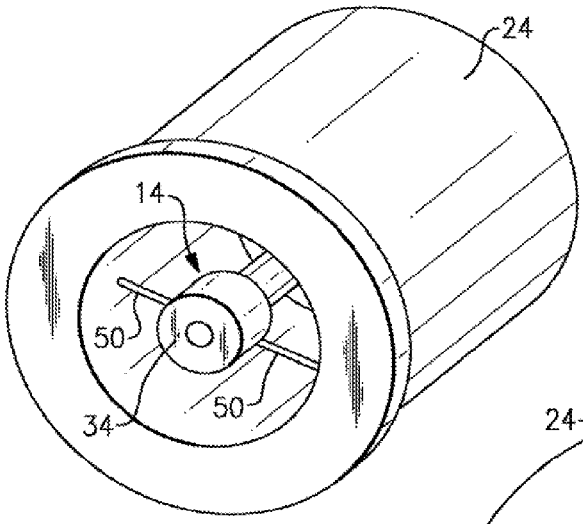
FIG. 6A is an isometric view of the compression ring and step up pin of a second embodiment of the coax cable connector of the present invention.
Figure 6B:
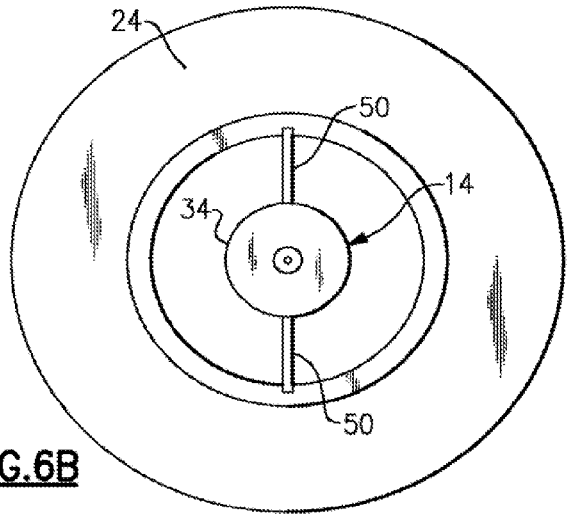
FIG. 6B is an end view of the compression ring and step up pin of FIG. 6A.

In an alternative embodiment, the step up pin 14 is stored in a concentric position within the compression ring 24 as shown in FIGS. 6A and 6B. According to this embodiment, the step up pin 14 is held within the compression ring 24 by a plurality of sprue tabs 50. The cable guide 34 is molded with the compression ring 24 with the sprue tabs 50 being formed therebetween. During assembly, the center conductor of the prepared coaxial cable engages the bore of the pin body 32 and the cable is pushed into the connector body 12 thereby breaking the sprue tabs 50 and driving the step up pin 14 to the pin guide 28, in the manner previously shown in FIGS. 5C-5E.

Figure 7A:
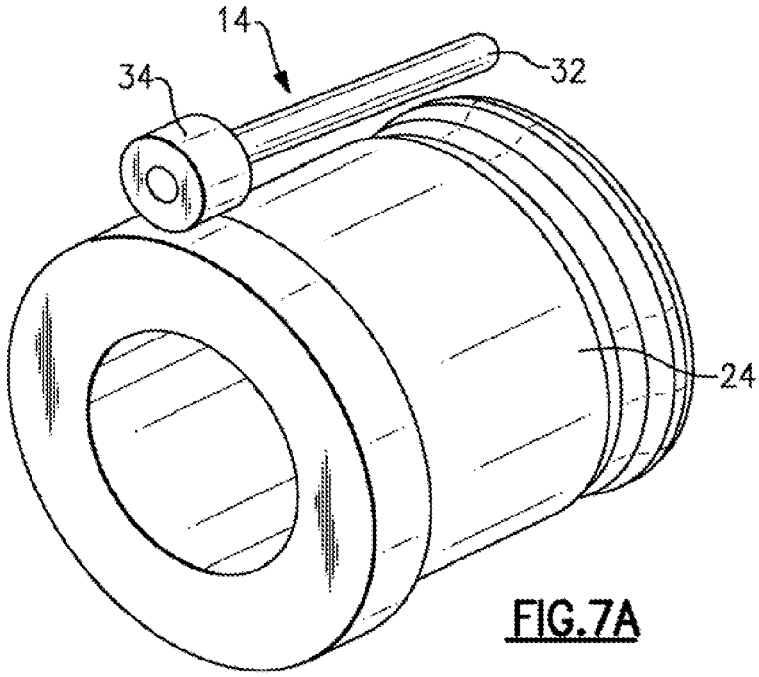
FIG. 7A is an isometric view of the compression ring and step up pin of a third embodiment of the coax cable connector of the present invention.
Figure 7B:
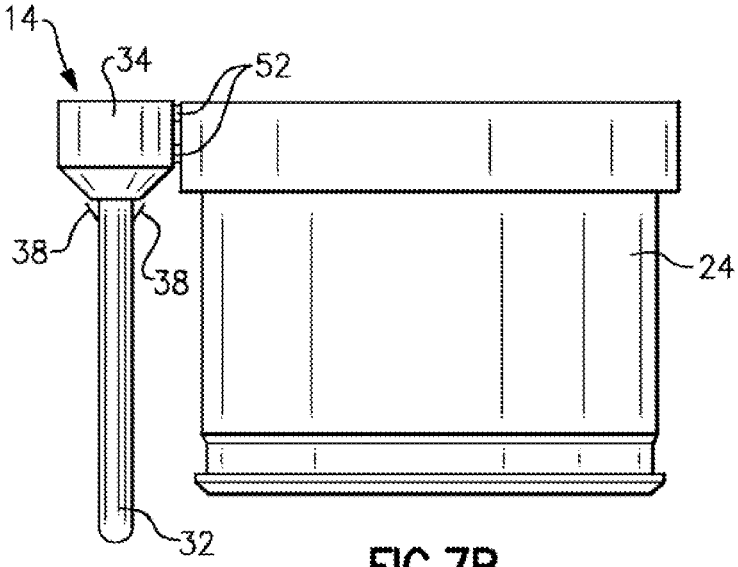
FIG. 7B is an end view of the compression ring and step up pin of FIG. 7A.

According to yet a further alternative embodiment, the step up pin 14 is stored in engagement with the outer surface of the compression ring 24 as shown in FIGS. 7A and 7B. The cable guide 34 is molded with the compression ring 24 with a plurality of sprue tabs 52 formed therebetween. The connector 10 is assembled onto a coax cable by inserting the center conductor into the bore 35 of the pin body 32 and twisting the step up pin 14 to break the sprue tabs 52 and remove the cable guide 34 from the compression ring 24. The assembly of the coax cable and the step up pin 14 is completed as described above with reference to FIGS. 5C-5E.

Figure 8A:
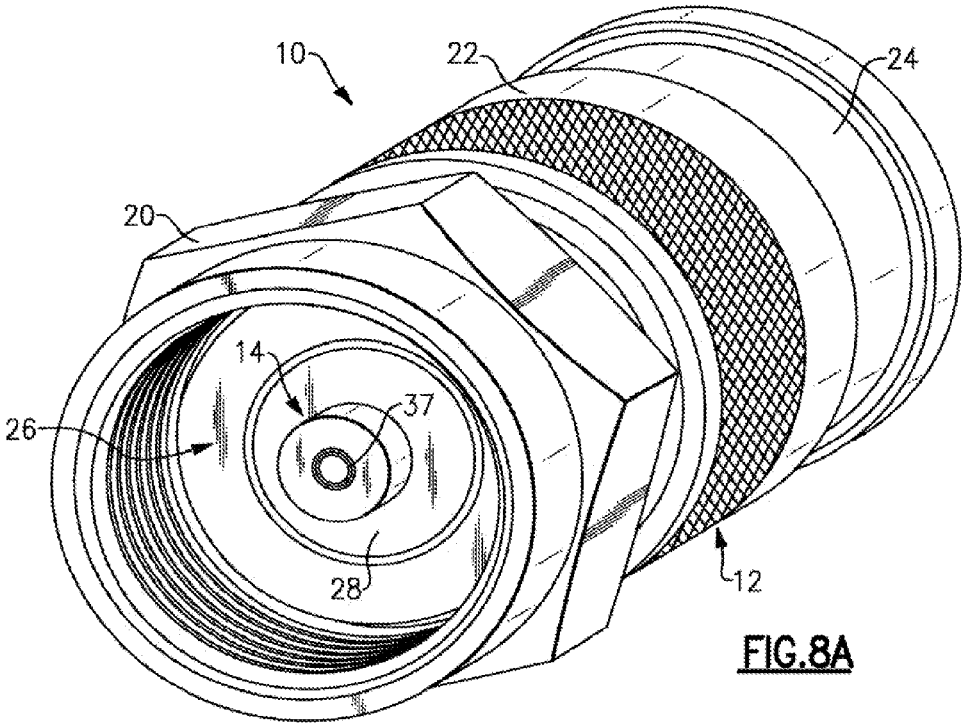
FIG. 8A is an isometric view of a fourth embodiment of the coax cable connector with the step up pin stored in engagement with the pin guide.
Figure 8B:
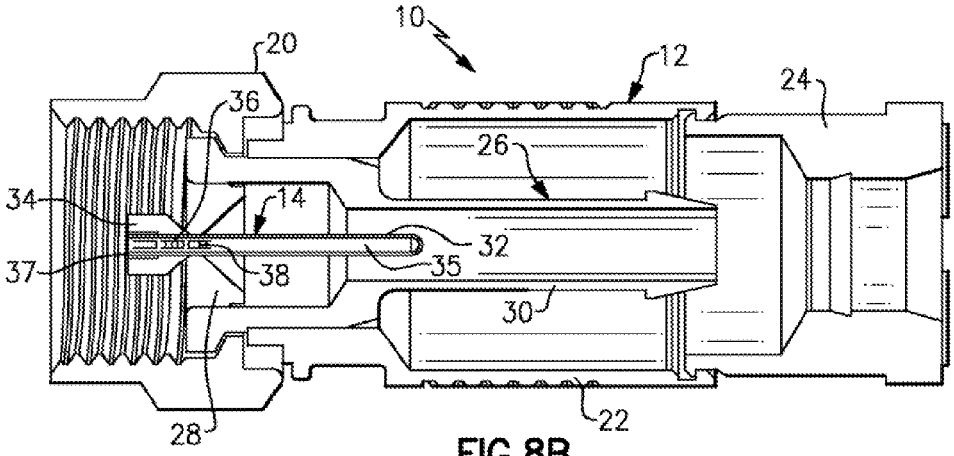
FIG. 8B is a cross-sectional side view of the coax cable connector of FIG. 8A.

In a particular embodiment shown in FIGS. 8A and 8B, the step up pin 14 is stored within the connector body 12 in a press-fit engagement with an axial through bore of the non-conducting pin guide 28. The step up pin 14 is axially inserted through the nut body 20 and into the pin guide 28 for storage within the connector body 12. The cable guide 34 is situated within the nut body 20 with the opening 37 of the pin body 32 being directed towards the opening of the nut body 20. The body of the step up pin 14 is therefore directed towards the compression ring end of the connector body 12. This has the advantage of providing easy access to the open end 37 of the blind bore 35 of the pin body 32 when assembling the step up pin 14 to the center conductor. The step up pin 14 is thus conveniently stored within the connector body 12, which protects the potentially fragile pin from damage during handling. The compression ring 24 does not require a sidewall bore or sprue tabs for retaining the step up pin before assembly.

Figure 9A:
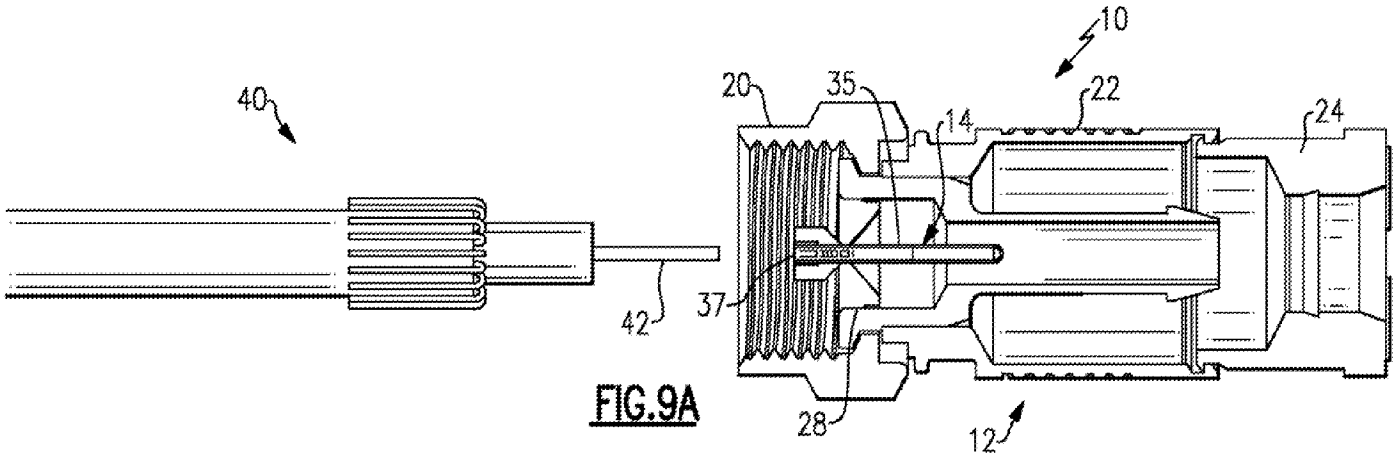
FIGS. 9A-9F are various views of the application of the step up pin and the coax cable connector of FIG. 8A onto a coax cable.
Figure 9B:
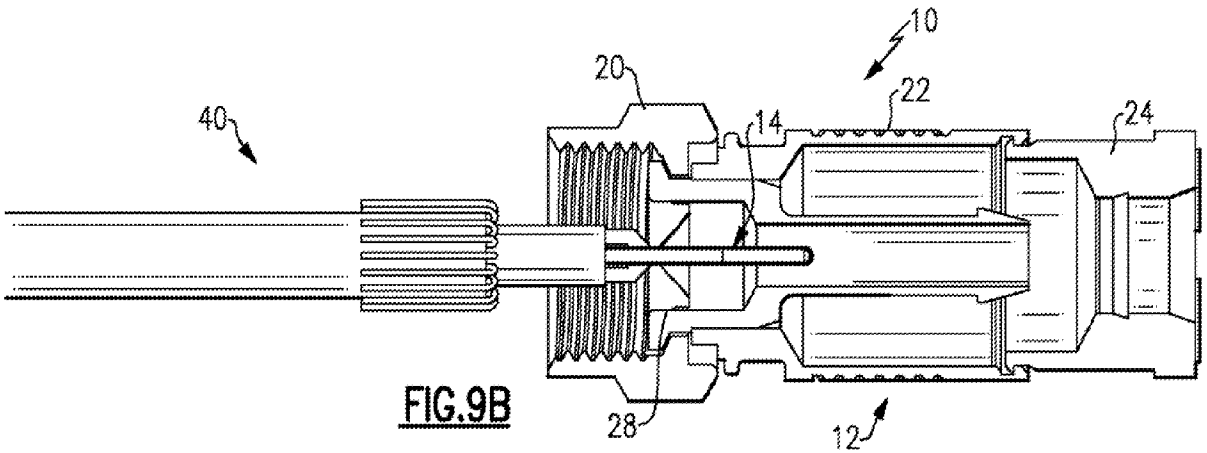
Figure 9C:
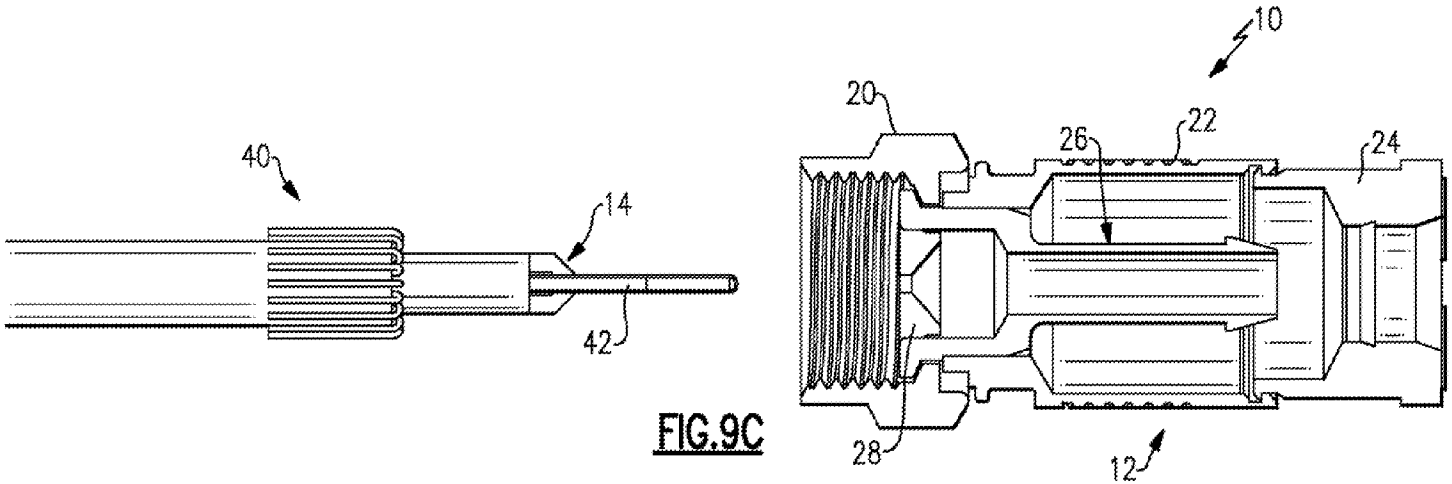
Figure 9D:
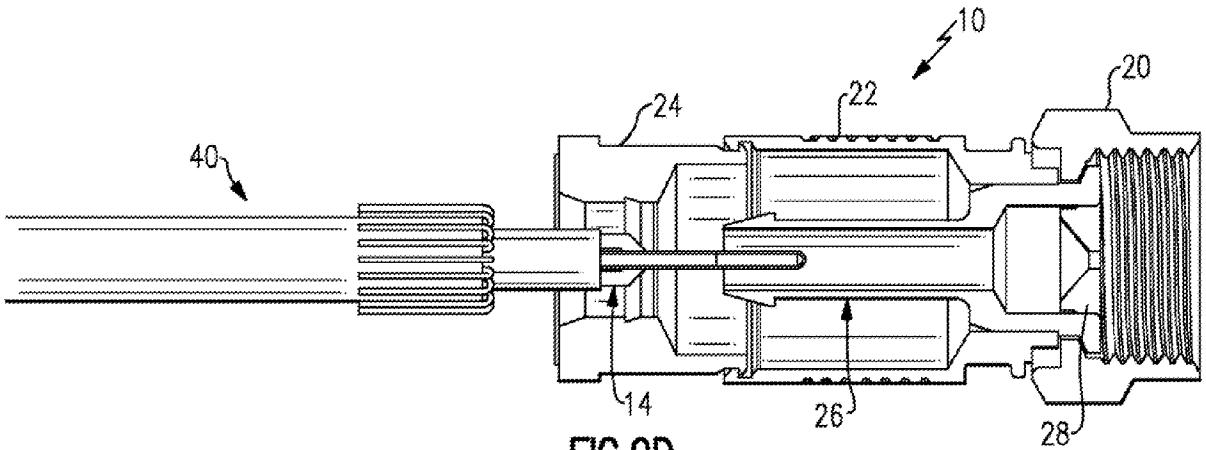
Figure 9E:
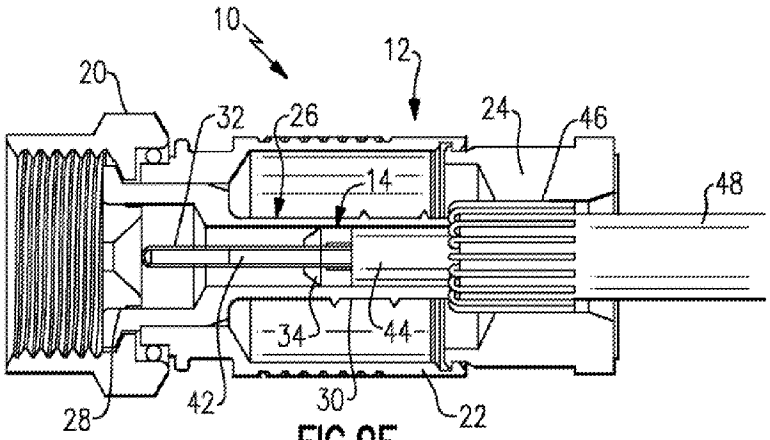
Figure 9F:
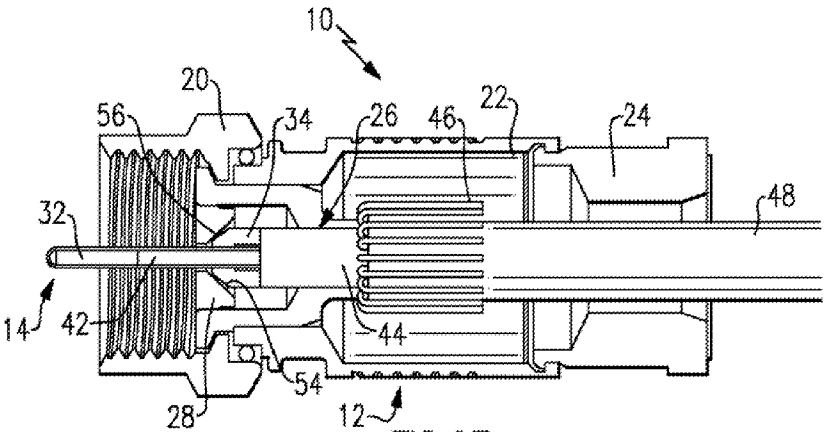

According to the preceding embodiment, the connector 10 is assembled onto the prepared end of a coax cable 40 by inserting the center conductor 42 through the open end 37 of the axial blind bore 35 via the axial bore of the nut body 20, as shown in FIGS. 9A and 9B. The spring fingers 36 of the step up pin 14 help secure the center conductor 42 within the axial blind bore 35. The user withdraws the cable 40 and the step up pin 14 from the nut body end of the connector body 12 and turns over the connector body 12 to insert the cable 40 and pin into the compression ring end of the connector body 12 as shown in FIGS. 9C and 9D. The step up pin 14 and the dielectric sleeve 44 are inserted into the axial bore of the inner post 26 such that the shaft 30 is forced in between the dielectric sleeve 44 and the outer conductor 46 as shown in FIG. 9E. The user continues to axially direct the cable 40 into the connector body 12 until a sloped surface 54 of the cable guide 34 engages a similarly sloped surface 56 provided on the pin guide 28, as shown in FIG. 9F. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

Figure 10A:
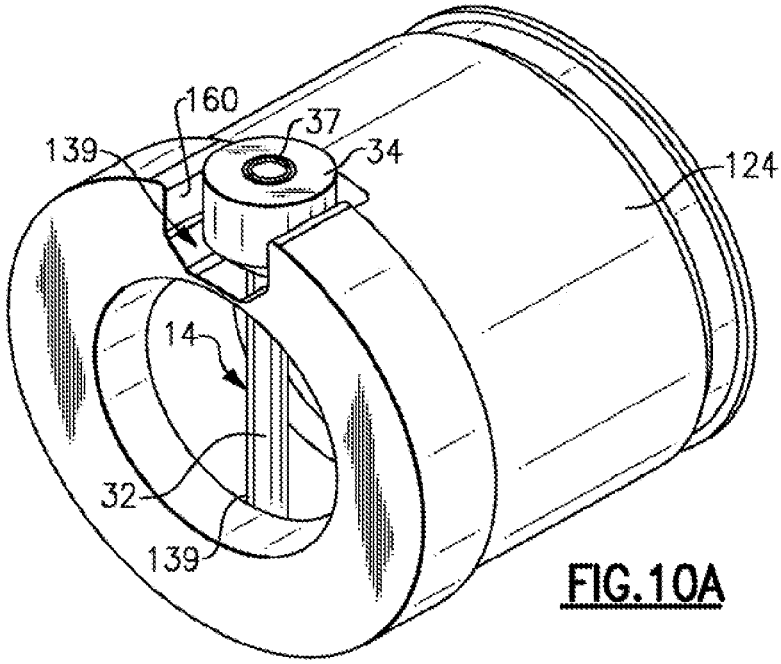
FIGS. 10A-10C are views of a particular embodiment of the coax cable connector with the step up pin stored in engagement with a countersunk sidewall bore in the compression ring.
Figure 10B:
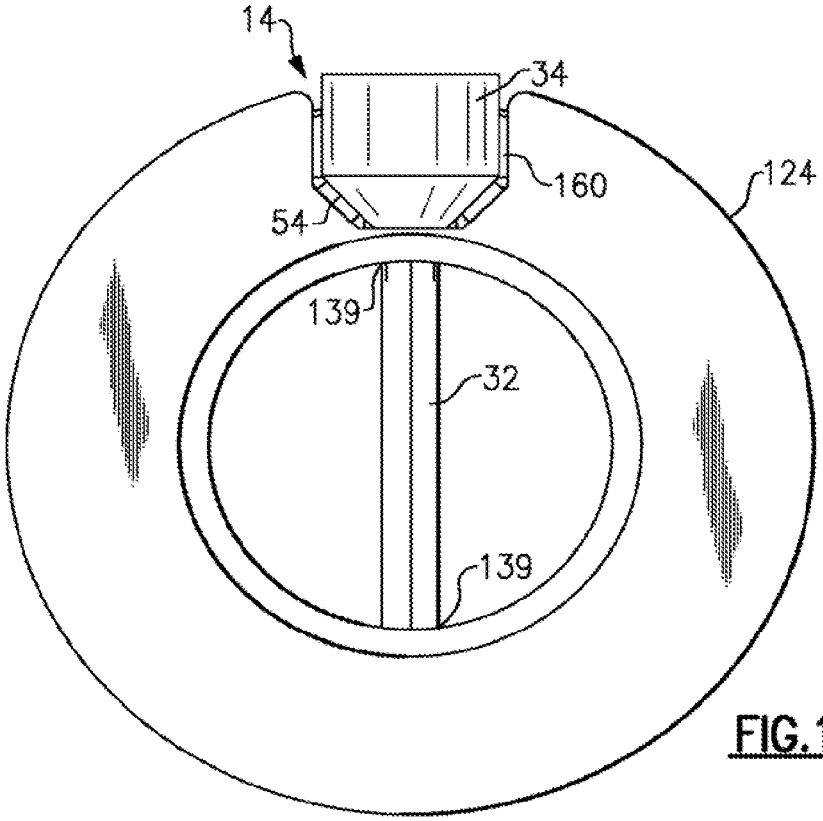
Figure 10C:
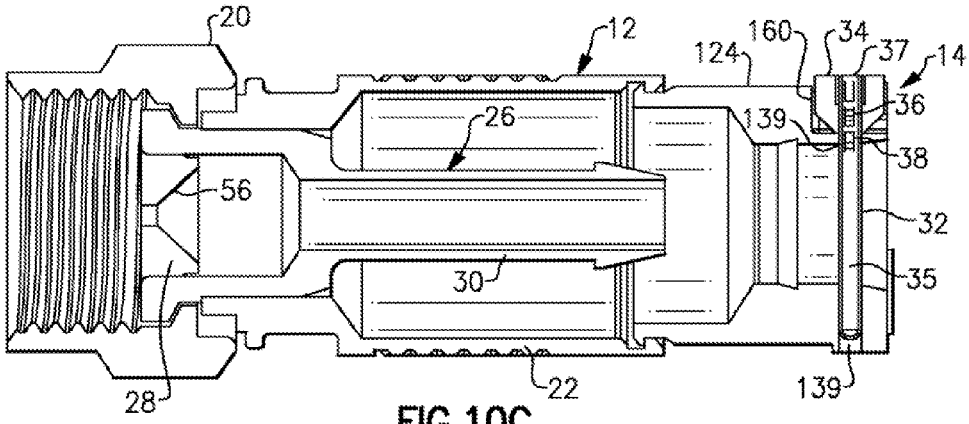

In a further particular embodiment shown in FIGS. 10A-10C, the step up pin 14 is stored in engagement with a sidewall bore 139 of the compression ring 124, similarly to that described above in relation to FIGS. 1, 2, 4A, and 4B. In the embodiment shown in FIGS. 10A-10C, however, the step up pin 14 is stored in a countersunk sidewall bore 139 that is formed in the compression ring 124. The sidewall bore 139 includes an enlarged recessed portion 160 that receives the guide 34, wherein the bore 139 continues through at least a portion of the opposing side of the compression ring 124 to receive the end of the pin body 32. Thus, little of the step up pin 14 is exposed outside the compression ring 124 during storage and the pin is therefore protected from damage during handling.

The connector 10 is assembled onto the prepared end of a coax cable as follows: The user inserts the center conductor 42 of the cable 40 into the open end 37 of the axial blind bore 35, withdraws the cable 40 with the step up pin 14 from the sidewall bore 139, and inserts the cable 40 and step up pin 14 into the axial bore of the compression ring 24, in the manner shown in FIG. 9D. The step up pin 14 and the dielectric sleeve 44 are inserted into the axial bore of the inner post 26 such that the shaft 30 is forced in between the dielectric sleeve 44 and the outer conductor 46 as shown in FIG. 9E. The user continues to axially direct the cable 40 into the connector body 12 until the sloped surface 54 of the cable guide 34 engages the complementarily sloped recess 56 of the pin guide 28 as shown in FIG. 9F. A compression tool (not shown) forces the compression ring 24 into the collar 22 such that the compression ring 24 compresses the jacket 48 and the outer conductor 46 against the shaft 30 to secure the cable 40 within the connector 10 and to provide conduction between the outer conductor 46 and the inner post 26.

Figure 11:
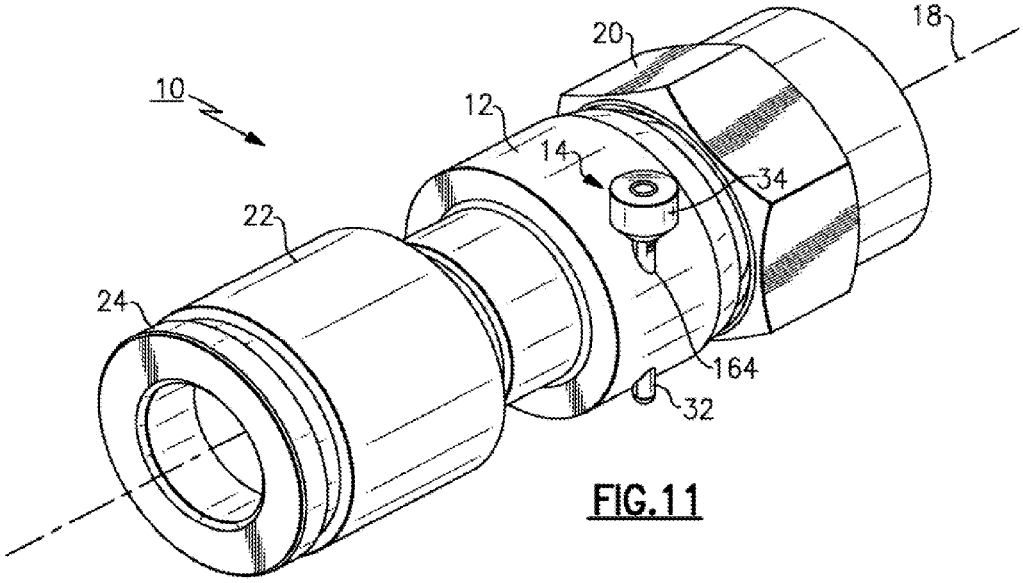
FIG. 11 is an isometric view of a coax cable connector having a step up pin mounted in accordance with another embodiment.
Figure 12:
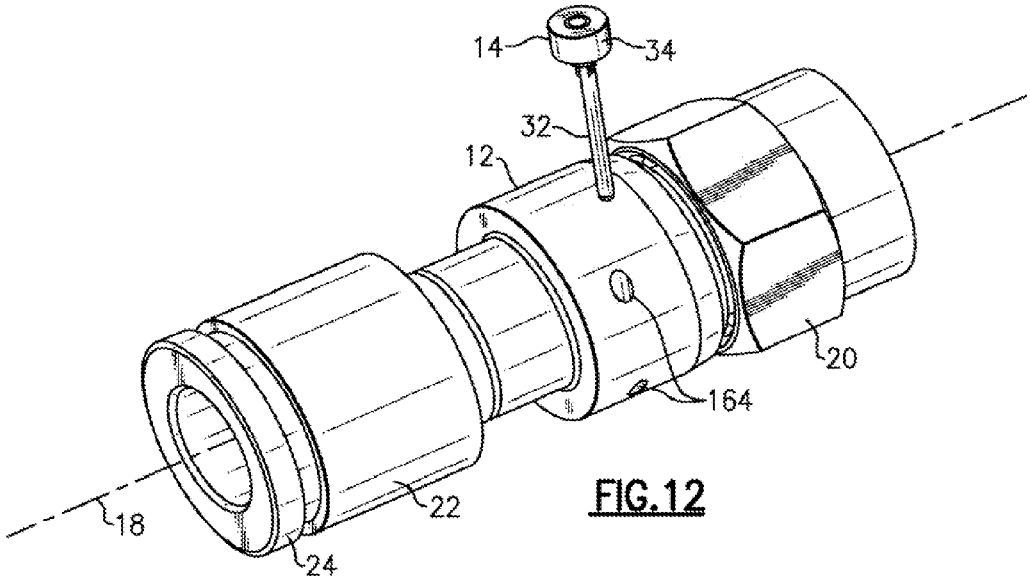
FIG. 12 is an isometric view of the coax cable connector of FIG. 12, with the step up pin removed therefrom.

Referring to FIGS. 11 and 12, there is shown a coax cable connector 10 made in accordance with another exemplary embodiment. For the sake of clarity and as in the previous embodiments, similar parts are herein also referenced with the same reference numerals. The coax cable connector 10, like the preceding, includes a connector body 12 and a step up pin 14. The connector body 12 as described in the preceding embodiments is defined by an assemblage of components that includes a threaded nut 20, a body section or collar 22 and a compression member or compression ring 24.

Each of the threaded nut 20, collar 22 and compression member 24 of the connector body 12 are assembled in coaxial fashion about a center axis, herein labeled by reference numeral 18. The functions of the collar 22, compression member 24, and nut 20 are similar to those previously described wherein the nut enables connection to an interface port, jack or other connector (not shown) and in which a peripheral coaxial cable end (not shown) is disposed in relation to the collar 22 and a contained hollow post (not shown). According to this embodiment, the step up pin 14, which includes a pin body 32 and a cable guide 34 having an axial bore 35 is attached in a storage position on the collar 22 having a bore 164 that extends through the sidewall of the collar in two peripheral areas, enabling the pin body 32 to be placed therein for retention, as shown in FIG. 11. The sidewall bore 164 is formed with a diameter that is sufficient to allow the pin body 32 access therethrough, but which is smaller than that of the cable guide 34.

Moreover, the sidewall bore 164 is disposed on the collar 22 in a tangential fashion such that the pin body 34, when mounted for storage prior to use, does not cross or intersect the center axis 18 of the connector 10; that is, the pin body 34 is "eccentrically" mounted in relation to the center axis 18 of the connector 10.

Figure 13:
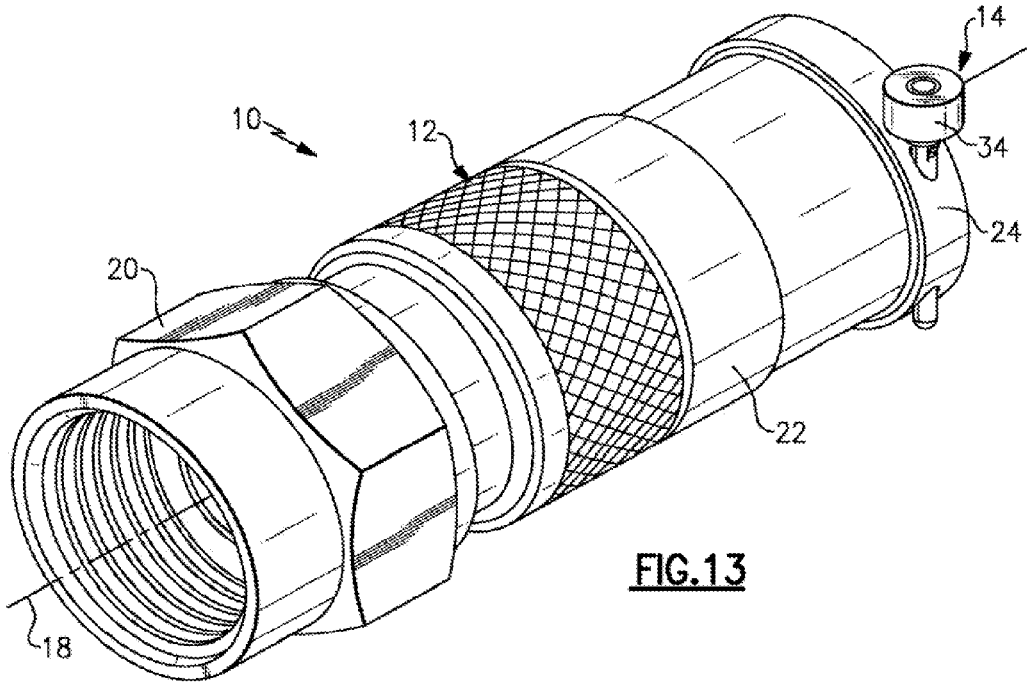
FIG. 13 is an isometric view of another coax cable connector having a step up pin mounted in accordance to another embodiment.
Figure 14:
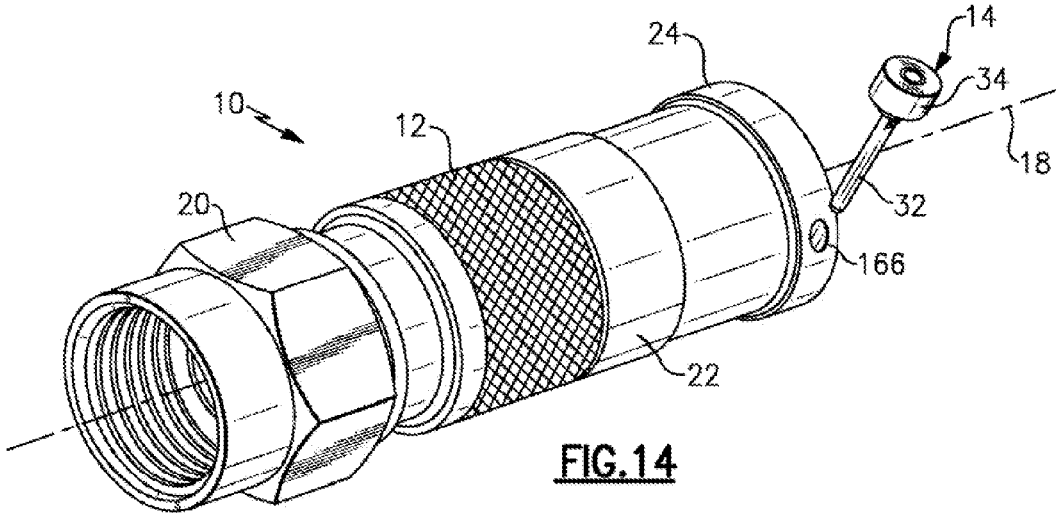
FIG. 14 is the isometric view of the coax cable connector of FIG. 13, with the step up pin removed therefrom.

The position of the sidewall bore 164 can be suitably varied along the connector 10. For example and as shown in FIGS. 13 and 14, a similar coax cable connector 10 includes a connector body 12 and a step up pin 14. The connector body 12 includes a threaded nut 20, a collar or body 22 and a compression member 24. In this particular embodiment, a bore 166 is disposed within the sidewall of the compression member 24. As in the preceding embodiment, the sidewall bore 166 is arranged tangentially through member such that the pin body 32 is stored so as not to intersect or cross the center axis 18 of the connector 10. The sidewall bore 166, as in the preceding version, is sized to retain the body 32 of the step up pin 14, but not the cable guide 34.

Figure 15:
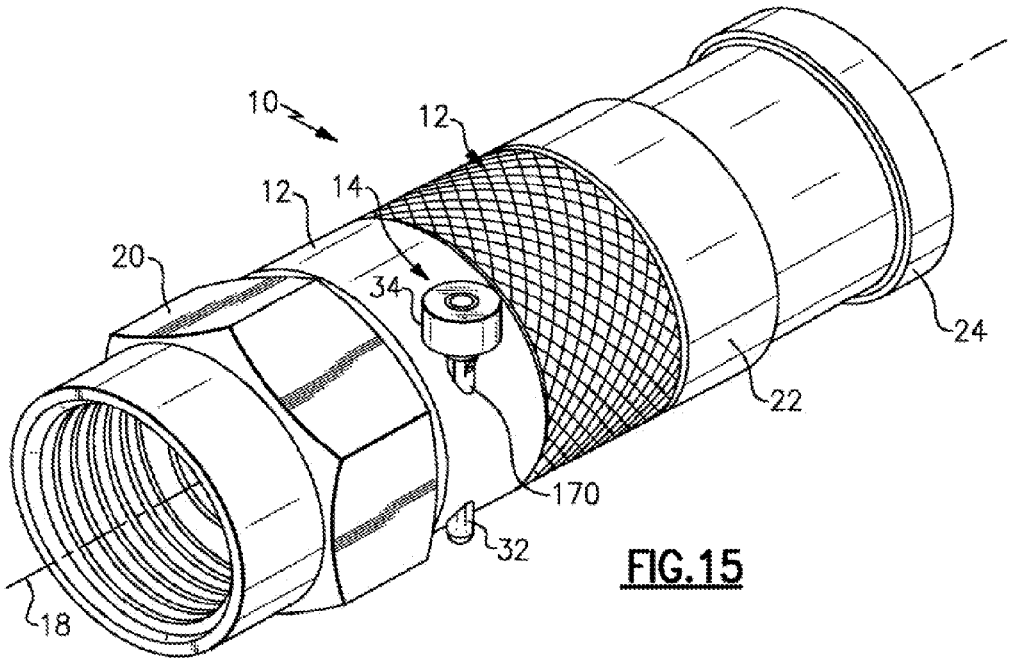
FIG. 15 is an isometric view of another coax cable connector having a step up pin mounted in accordance with yet another embodiment.

Yet another alternative embodiment is shown in FIG. 15 wherein a step-up pin 14 is attached to a coax cable connector 10 through a sidewall bore 170 provided tangentially through the sidewall of the collar 22. As in the preceding versions, the step-up pin 14 when stored within the sidewall bore 170 neither intersects or crosses the center axis of the connector 10. Similar bores could be provided elsewhere on the connector body 12. For example and though not shown, a bore could be provided in any of the collar 22, compression member 24 and/or threaded nut 20.

In each of the foregoing examples shown in FIGS. 11-15, the step up pin 14 can be accessed by the end of a peripheral coaxial cable (not shown), wherein the center conductor of the cable can be advanced into the blind bore 37 of the pin body 32 and in which the step up pin 14 can be withdrawn from the bore. The coaxial cable, including the attached step-up pin 14, can then be placed within the connector 10 by placing the cable end through the open compression member side of the connector 10, in the manner previously described according to FIGS. 5A-5E.

Figure 16:
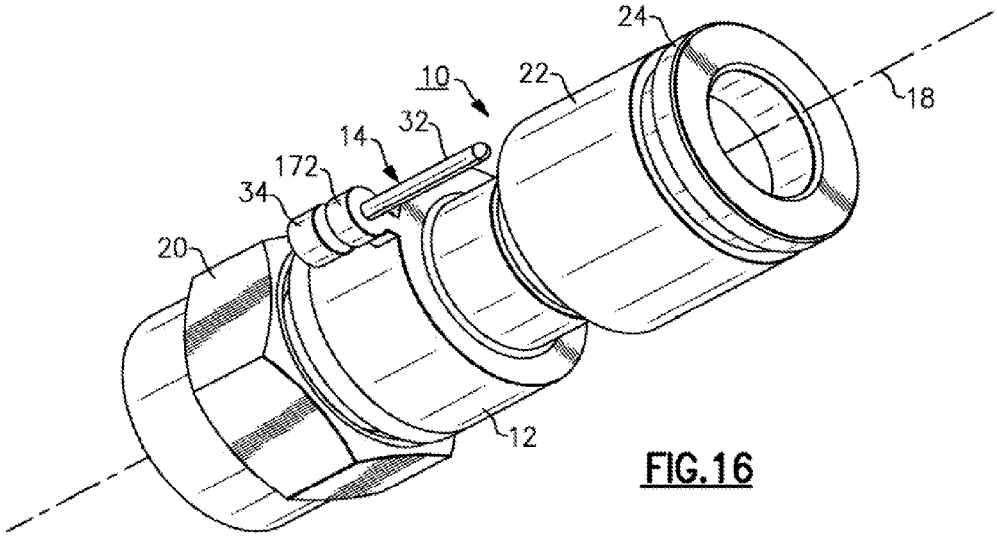
FIG. 16 depicts an isometric view of another coax cable connector having a step up pin mounted to the connector in accordance with yet another embodiment.
Figure 17:
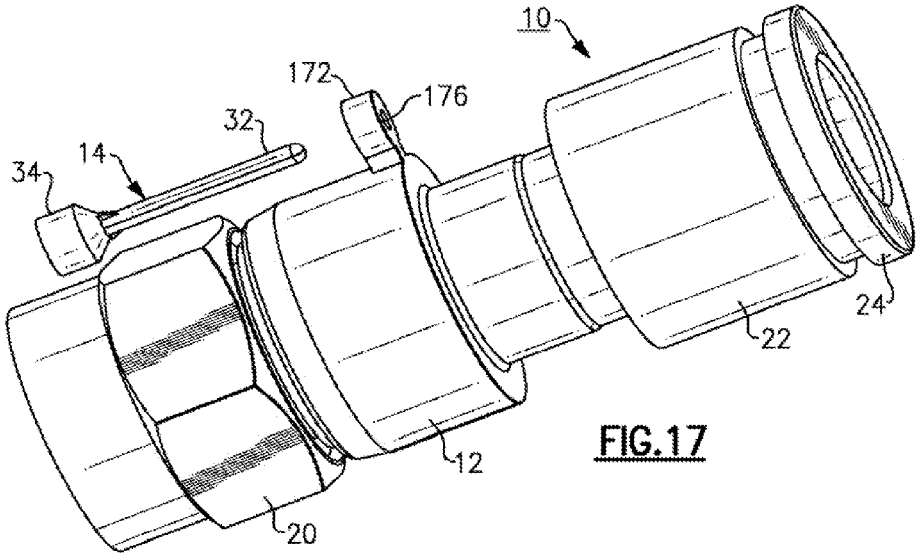
FIG. 17 is the isometric view of the coax cable connector rotated clockwise approximately 45 degrees, with the step up pin removed therefrom.

Yet another exemplary embodiment is depicted in FIGS. 16 and 17. The coax cable connector 10 used for purposes of this embodiment is similar to each of the foregoing in that the connector includes a connector body 12 and a step up pin 14. The connector body 12 is an assemblage of components that includes a threaded nut 20, a collar 22 and a compression member 24. According to this embodiment, a pin receptacle 172 is integrated within the connector body 12 and more specifically as part of the collar 22. As defined herein, the collar 22 including the pin receptacle 172 can be made as a molded plastic component or can alternatively be manufactured from any suitable electrically non-conductive or conductive material.

The pin receptacle 172 extends radially outward from the exterior surface of the collar 22, the receptacle 172 being a substantially cylindrical section having a axial through bore 176 which is sized to receive the pin body 32, but not the cable guide 34 of a step-up pin 14. A portion of the pin body 32 extends outwardly from the confines of the pin receptacle 172 in a direction which is substantially parallel to that of the center axis 18, FIG. 16, of the connector 10. That is, the axis of the axial bore 176 extends in a direction that is substantially parallel to the center axis 18 of the connector 10, but radially offset therefrom.

Figure 18:
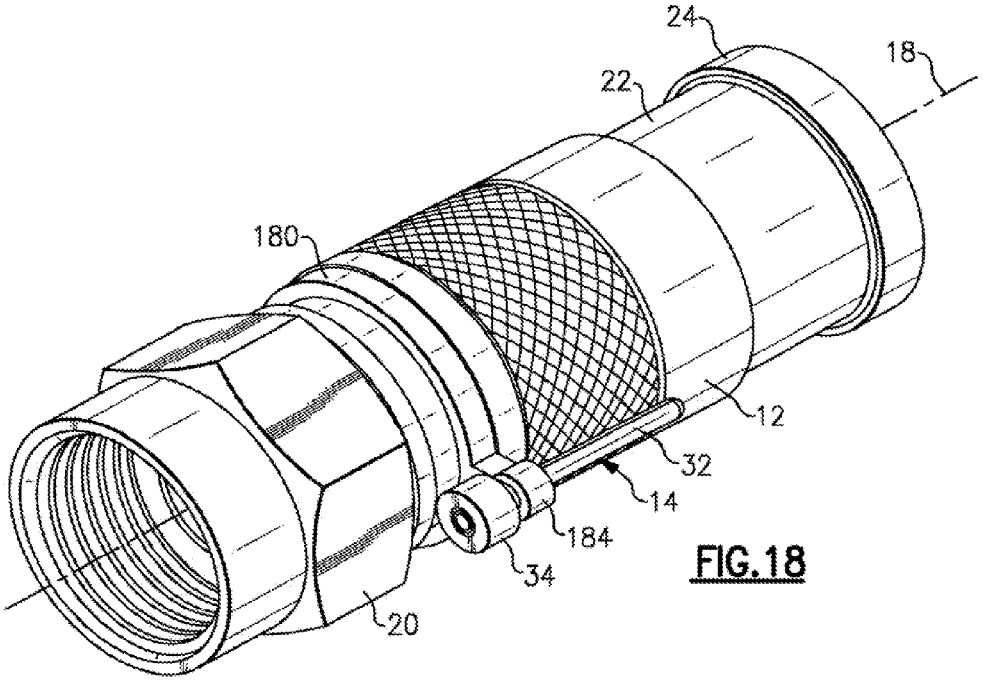
FIG. 18 is an isometric view of a coax cable connector having a step up pin mounted in accordance with another exemplary embodiment.
Figure 19:
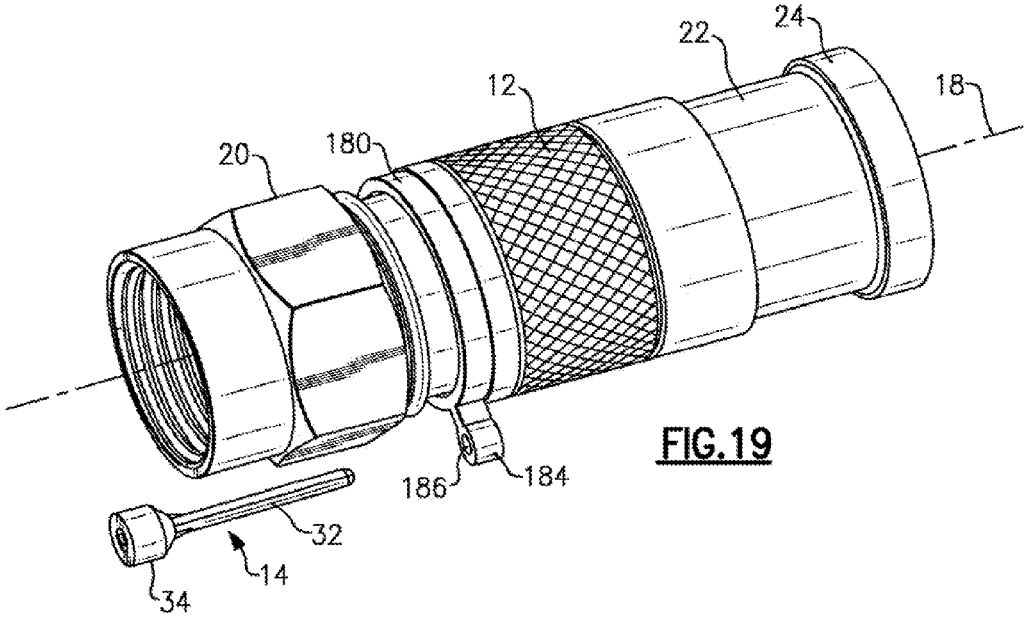
FIG. 19 is another isometric view of the coax cable connector of FIG. 18, with the step up pin removed therefrom.
Figure 20:
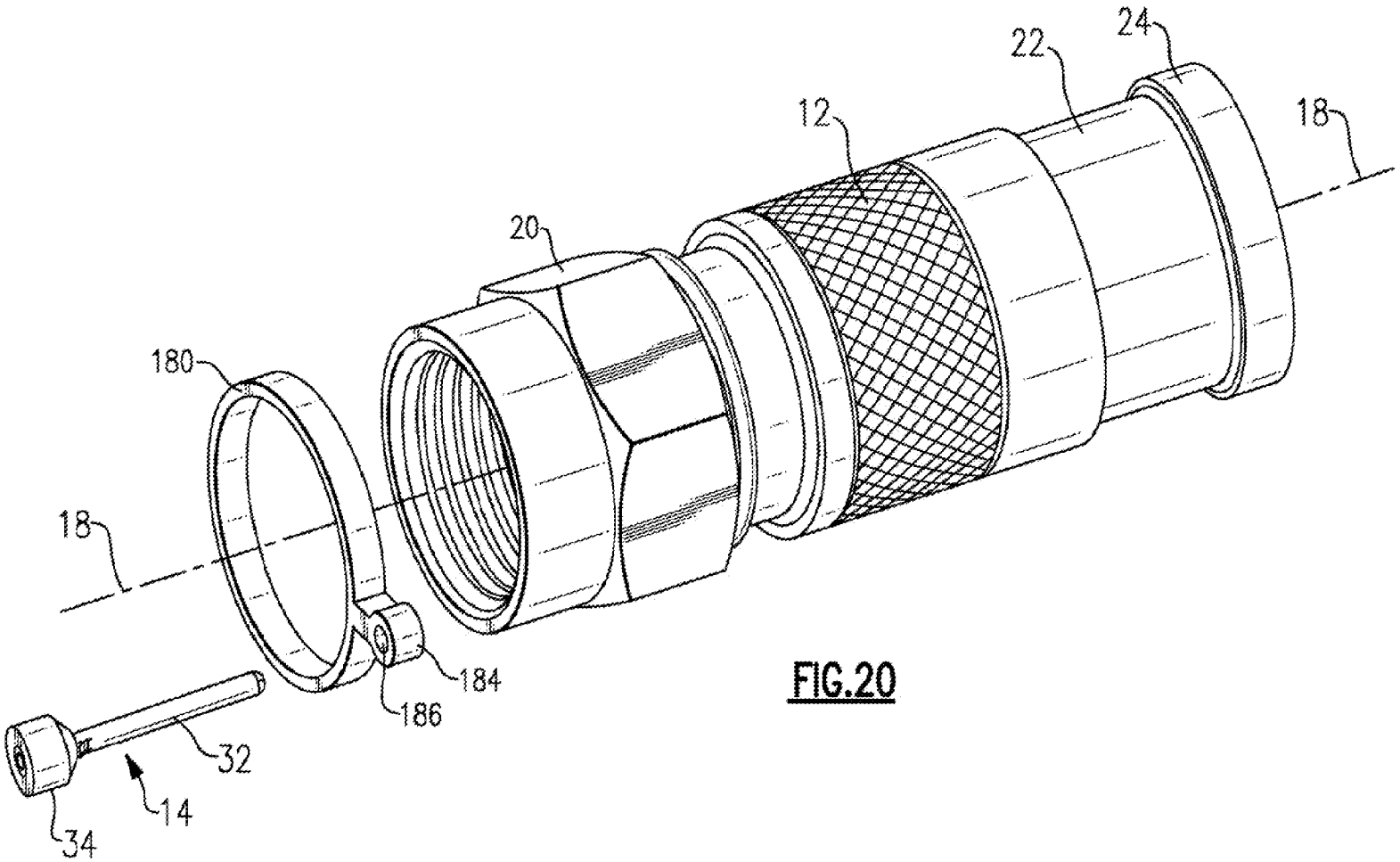
FIG. 20 is a partially exploded view of the coax cable connector of FIGS. 18 and 19.

The pin receptacle 172 can be integral to any portion of the connector body 12 as described according to FIGS. 16 and 17 or according to an alternative embodiment, the pin receptacle 172 can be provided upon a separately mounted component 180, such as shown in FIGS. 18-20. According to the latter version, this separate component 180 can be a ring-like member having a radial projection 184 that includes an axial bore 186 sized for receiving the body 32 of a step up pin 14 with the exception of the cable guide 34 for storage or retention thereof prior to use.

Still referring to FIGS. 18-20, the ring-like component 180 is sized to permit placement between the nut body 20 and the first end of the collar 22, as shown in FIG. 19 or over a distal extending portion of the nut body 20 as shown in FIG. 20.

Figure 21:
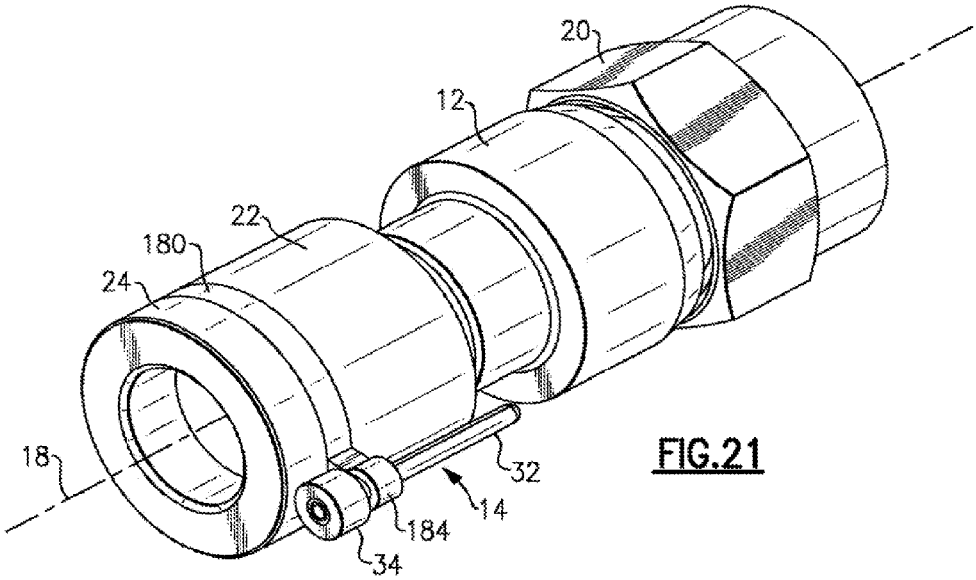
FIGS. 21, 22 and 23 relate to another embodiment of a coax cable connector having a step up pin mounting arrangement.
Figure 22:
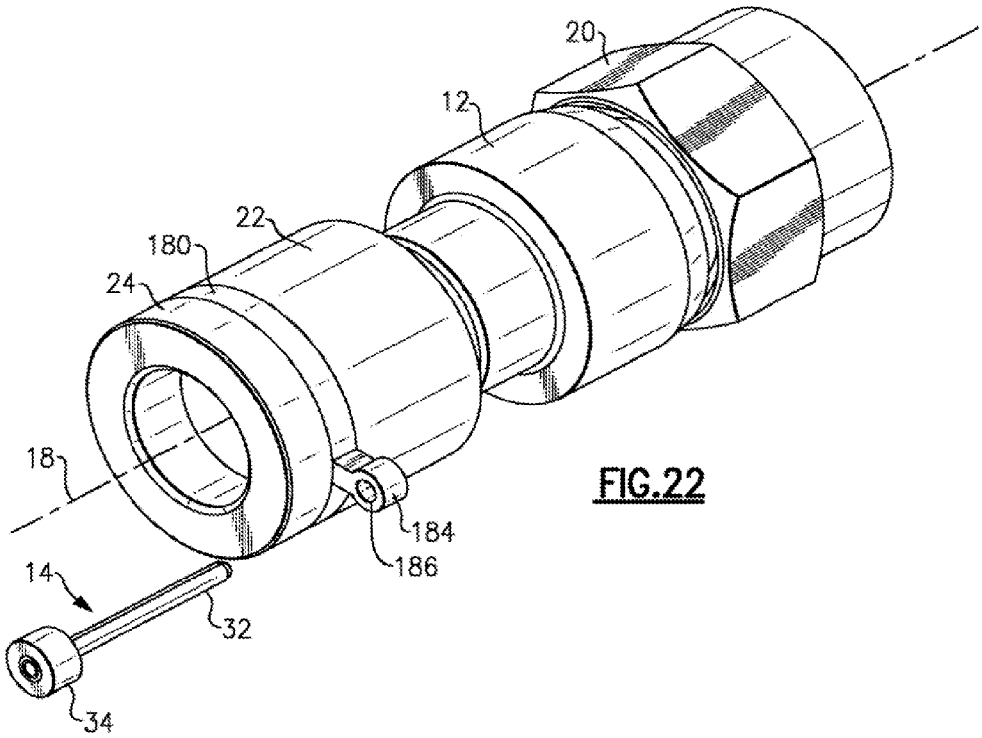
Figure 23:
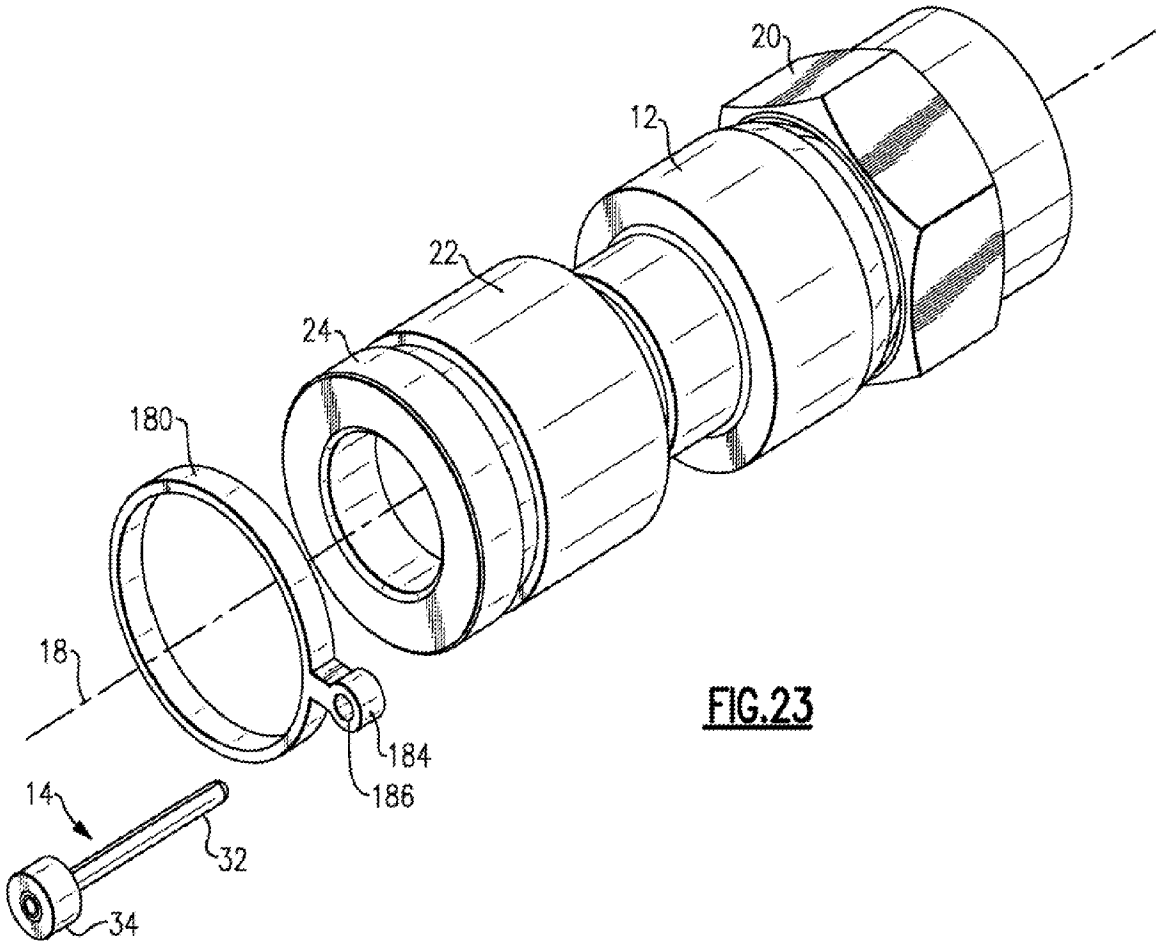

According to yet another alternative embodiment, a ring component 180 such as described above could also be similarly positioned between the collar 22 and the compression member 24, as shown in FIGS. 21-23. Other suitable locations though not shown specifically should be readily apparent wherein each location enables the step-up pin 14 to be easily stored without risk of damage in advance of use thereof and easily secured to the center conductor of a coax cable, for assembly to the connector 10 as described in the manner above, for example, in FIGS. 5C-5E and 9C-9E. In each of these embodiments, the pin receptacle 184 stores the step up pin 14 so as not to cross or intersect the center axis 18 of the connector 10. In the previous version, for example, the position of the receptacle 184 is sufficiently outboard radially to permit the step up pin 14 to be accessed and withdrawn by a coax cable (not shown) without interfering with the nut 20.

It should be readily apparent that the foregoing concepts can be similarly applied to other connector designs. For example and referring to FIGS. 24-26 a broadband cable connector 200 is provided, this connector having a connector body 210 that is defined according to this version by a nut 220, a collar or body portion 230, a compression member 240 and an inner post 250. The nut 220 as defined herein includes opposing first and second ends 222, 224 as well as center passageway 225 extending therethrough, wherein an intermediate portion of the interior or inner surface of the nut is threaded. The body portion 230 includes a first end 232 and an opposing second end 234 having a center passageway 235 defined therethrough. The first end 232 is further defined by a flanged portion 236 that includes a distally extending basket 237. The basket 237 is made from an electrically conductive material and includes a plurality of axial slots 238 to permit engagement with a remote appliance port (not shown).

Figure 26:
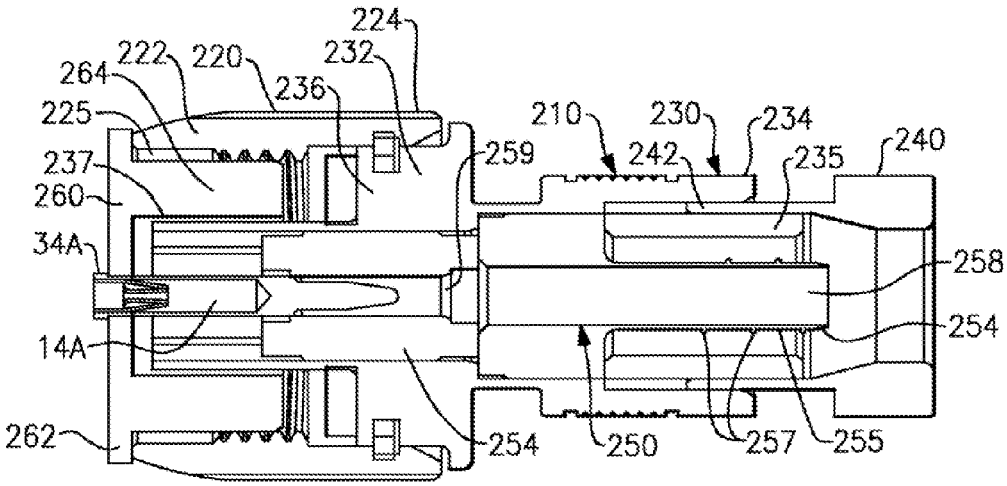
FIG. 26 is a side sectioned view of the coax cable connector of FIG. 25.

The second end 238 of the body portion 230 is sized to receive a distal end 242 of the compression member 240, as shown in FIG. 26. The inner post 250 includes a first end 254 and an opposing second end 256 with a center passageway 258 extending therethrough. The second end 256 of the inner post 250 is at least partially defined by a shaft 255 having a plurality of barbs 257 for engagement with a prepared coaxial cable end (not shown), wherein the shaft 255 extends within the hollow confines of the body portion 230, as most clearly shown in the sectioned elevational view of FIG. 26. The first end 254 of the post 250 is fitted within the flanged portion 236 of the body portion 230 and includes a pin guide 259. The nut 220 is mounted for rotation to the first end 232 of the body section 230 wherein the basket 237 extends distally and axially from the first end 232 of the body portion 230 and the first end 254 of the inner post 250. As noted, the first end 242 of the compression member 240 is fitted within the second end 234 of the body section 230 for securing a prepared coaxial cable end, wherein the outer conductor and sheath are stripped by the barb 257 and the dielectric layer and center conductor each pass through the center passageway 258 of the post 250, the center conductor (and step up pin 14A, when attached) extending therethrough to the pin guide 259.

According to this version a pin retaining member 260 is engages the open first end 224 of the nut body 220, the pin retaining member 260 according to this embodiment having a disc-like body 262, which further includes an extending cylindrical engagement section 264. The engagement section 264 is sized to fit about the basket 237 of the connector 200 wherein the pin retaining member 260 includes a center opening 268 that is sized to receive the pin body 32A of a step up pin 14A. As noted previously, a pin guide 259 provided on the first end 254 of the inner post 250, accommodates the step up pin 14A, following attachment to a center conductor and insertion of a coax cable into the compression member side of the connector 200. More specifically, the pin body 32A according to this specific embodiment includes a stepped distal portion, and a cable guide 34A wherein the pin body further includes a blind bore. Other suitable pin designs should be readily apparent, depending on the specific connector design and coaxial cables that are used wherein the body of the pin and pin guide can be suitably and complementarily shaped for engagement in use.

In this version, the pin retaining member 260 aids in positioning the step up pin 14A, as well as creating storage therefore prior to use without risk of damage, enabling the pin to be easily accessed as needed.

Figure 27:
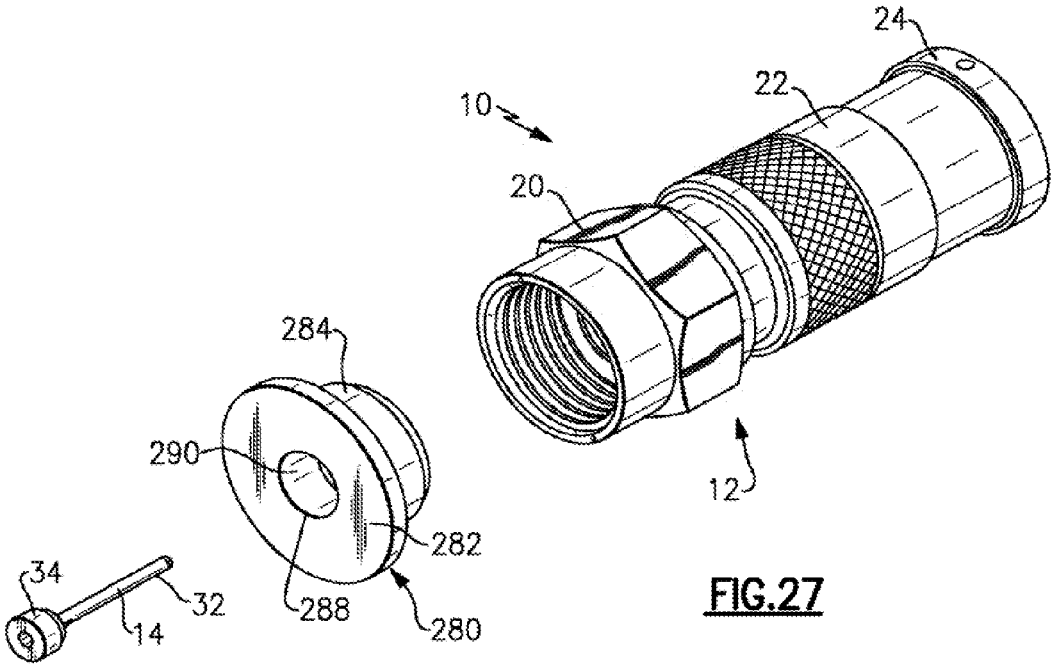
FIG. 27 is a partially exploded view of a coax cable connector having a step up pin mounted in accordance with yet another exemplary embodiment.
Figure 28:
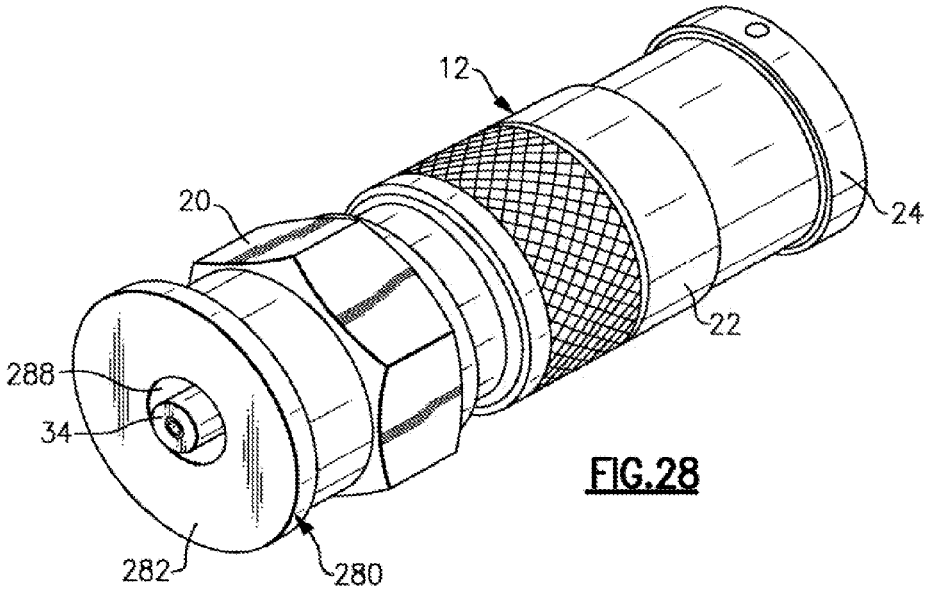
FIG. 28 is a side perspective view illustrating the coax cable connector of FIG. 27 in an assembled condition.
Figure 29:
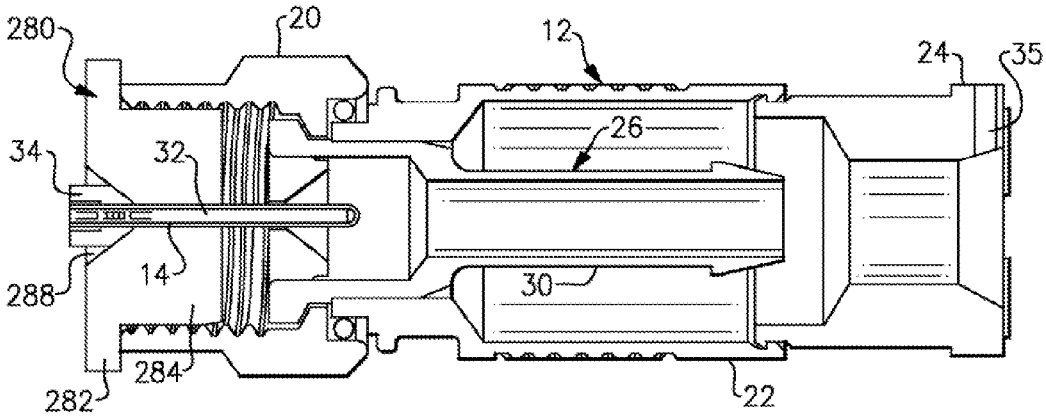
FIG. 29 is a side sectioned view of the coax cable connector of FIG. 28.

Similar embodiments are herein illustrated for other forms of coax cable connectors, such as the connector previously and generally discussed according to FIGS. 1-2 having a connector body 12 defined by a nut 20, a collar or body section 22 and a compression member 24. Referring to FIGS. 27-29, a pin retaining member 280 is defined by a body 282 that is sized to releasably fit within the end opening of the nut 20, the pin retaining member having a cylindrical engagement portion 284 to provide this latter engagement. The pin retaining member 280 includes a center opening 288 extending therethrough that is sized to accommodate a step up pin 14 wherein the pin body 32 can be fitted, wherein the pin is further protected from contact prior to use thereof. The center opening 288 is provided with a recess 290 according to this embodiment, permitting the cable guide 34 of the step up pin to also be at least partially covered and protected, as shown in FIG. 29. The center opening 288 itself permits passage of the pin body 32 into the connector 10 until use is required.

Figure 30:
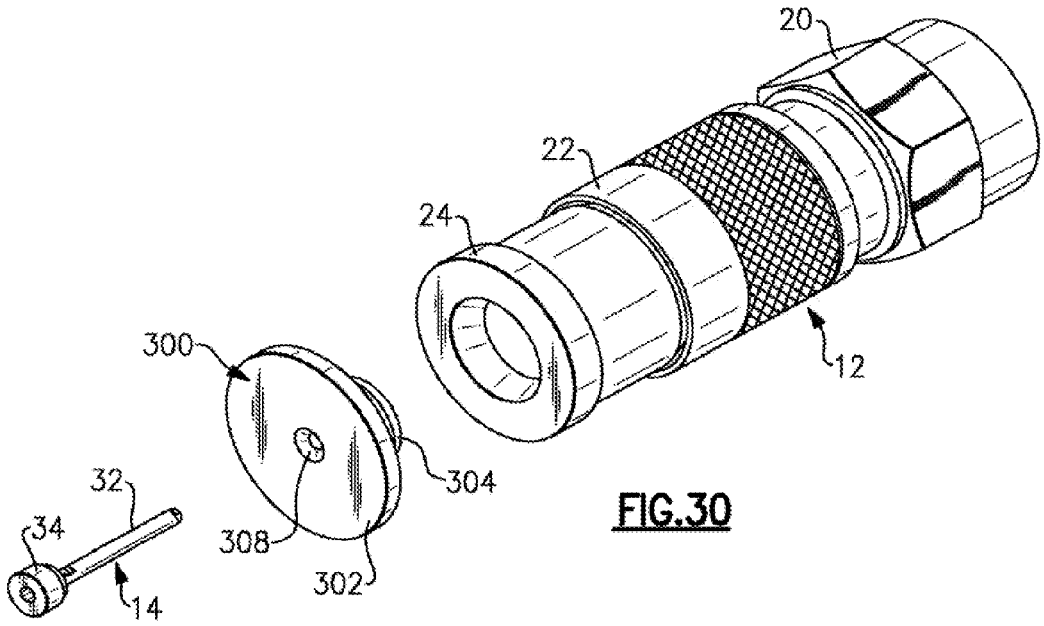
FIG. 30 is a partially exploded view of a coax cable connector having a step up pin mounted in accordance with yet another exemplary embodiment.
Figure 31:
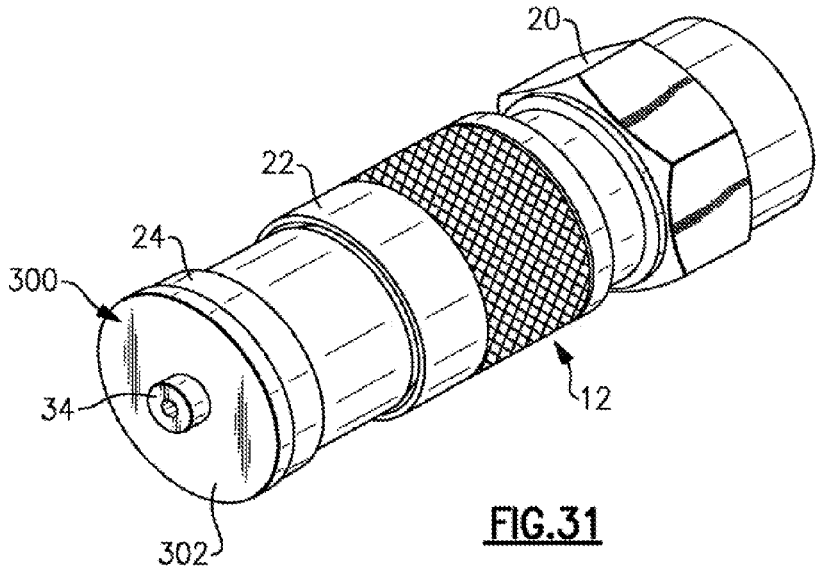
FIG. 31 is a side perspective view of the coax cable connector of FIG. 30 in an assembled condition.
Figure 32:
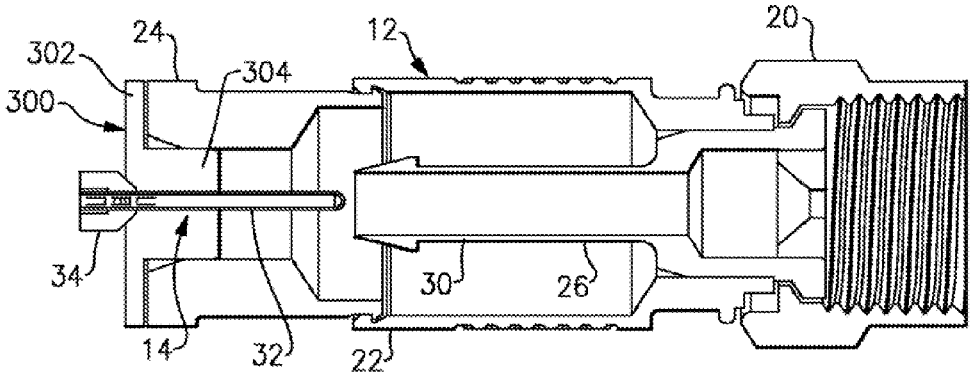
FIG. 32 is a side sectioned view of the coax cable connector of FIG. 31.

Additional embodiments of the foregoing are possible wherein the attachment position of the pin retaining member 260, 280 for each of the preceding embodiments can be reversed. That is and referring to FIGS. 30-32, a pin retaining member 300 can be releasably attached to the central bore of the compression member 24 of a connector 10 in lieu of the nut body 20 previously discussed at FIGS. 27-29. In this embodiment, the pin retaining member 300 similarly includes a body 302 having an extending cylindrical engagement section 304 sized to be fitted within the opening defining the bore of the compression member 24. A center opening 308 extending therethrough permits the retention of the pin body 32 of the step up pin 14 with the cable guide 34 extending outwardly therefrom. The body 302 of the pin retaining member 300 includes a diameter that matches that of the compression member 24. In this specific version, the center opening 308 of the pin retaining member 300 is not recessed.

Figure 24:
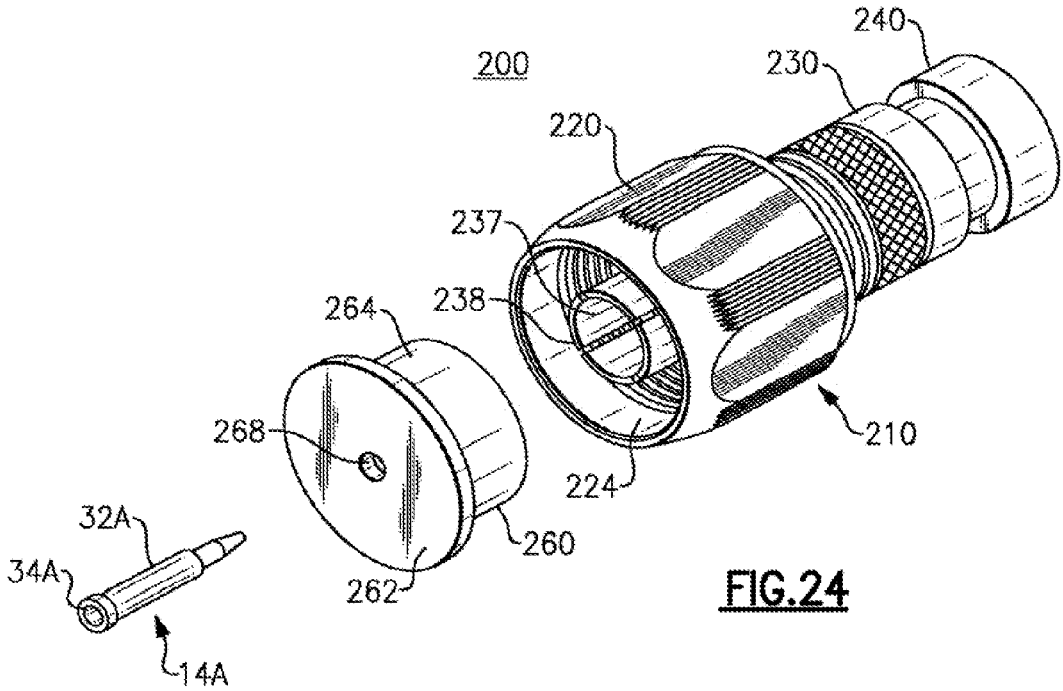
FIG. 24 is a partially exploded view of a coax cable connector having a step up pin attached in accordance with yet another exemplary embodiment.
Figure 25:
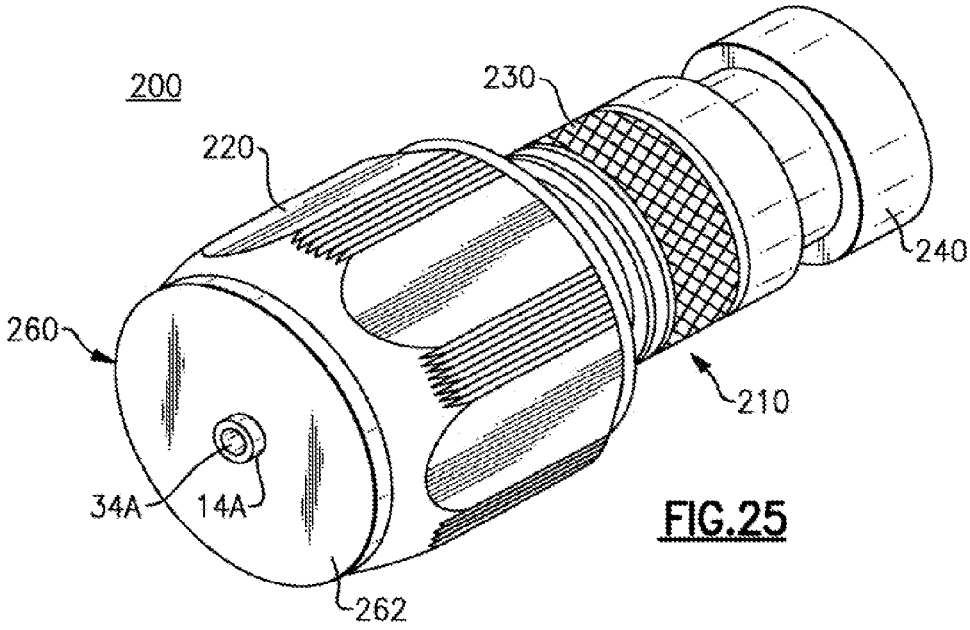
FIG. 25 is a side perspective view illustrating the coax cable connector of FIG. 24 in an assembled condition.
Figure 33:
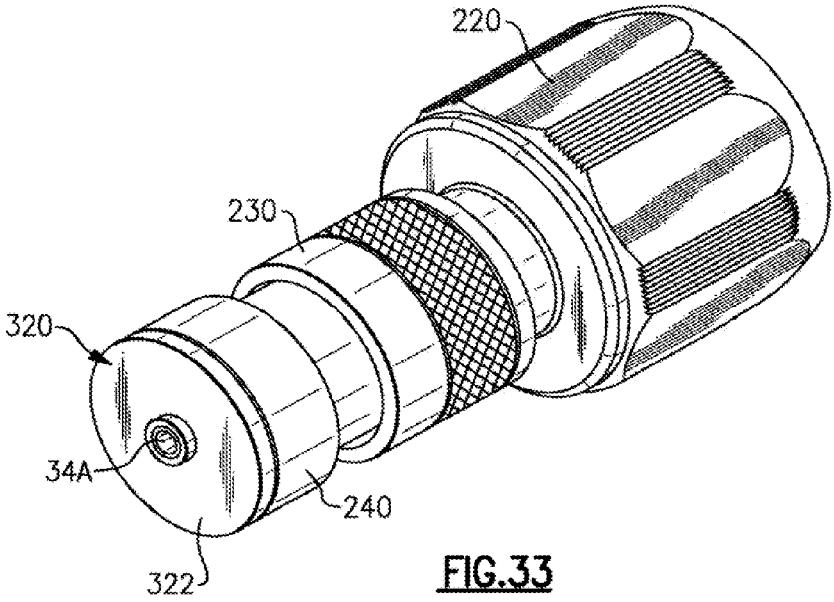
FIG. 33 is a partially exploded assembly view of a coax cable connector having a step up pin mounted in accordance with another exemplary embodiment of the present invention.
Figure 34:
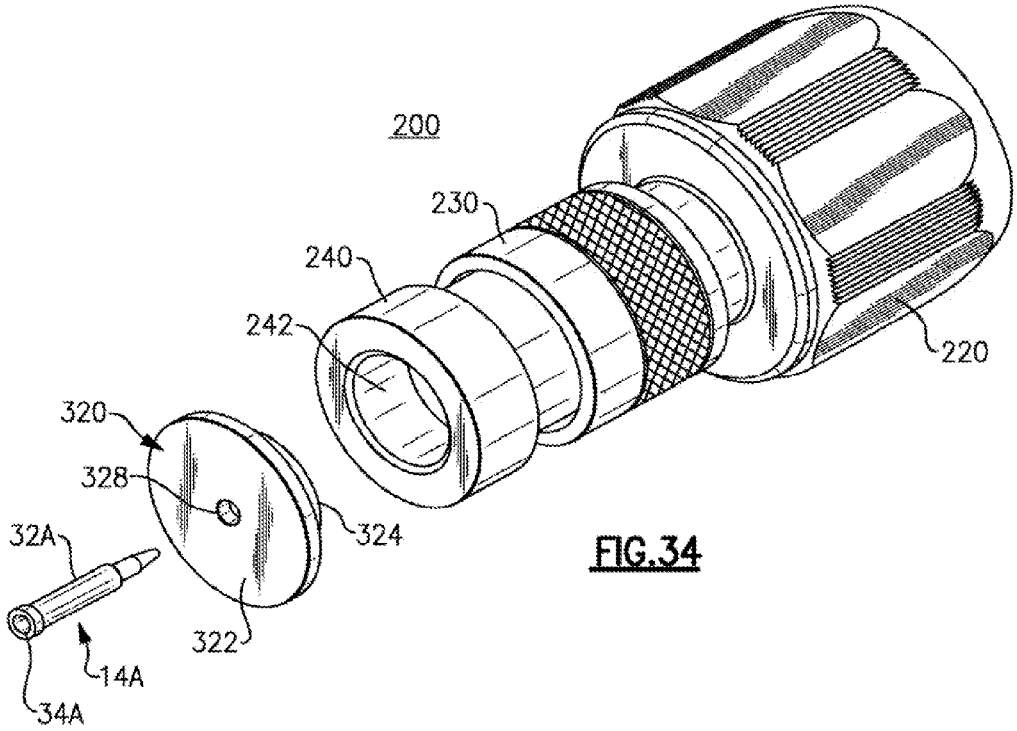
FIG. 34 is a side perspective view of the coax cable connector of FIG. 33 in an assembled condition.
Figure 35:
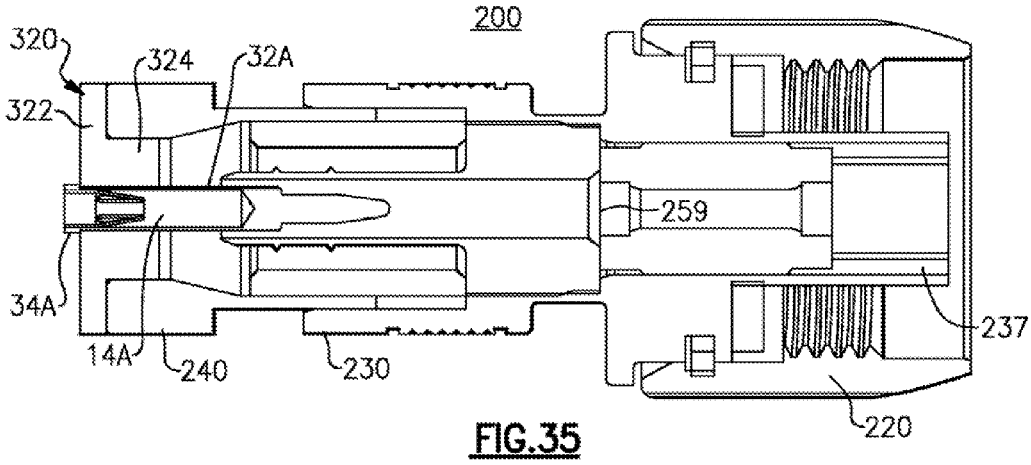
FIG. 35 is a side sectioned view of the coax cable connector of FIG. 34.

A similar version of a pin retaining member 320 can be provided as shown in FIGS. 33-35 for the connector 200 previously discussed at FIGS. 24-26 wherein a cylindrical engagement portion 324 of the holder is sized to releasably engage the bore 242 of the compression member 240. The pin retaining member 320 is defined by a body 322 that is shaped to conform to that of the compression member 240 and further includes a center opening 328 that permits the passage of the pin body 32A, but not the cable guide 34A of a step up pin 14A.

In each of the preceding versions of the pin retaining member 260, 280, 300, 320, this component can be made from a moldable plastic, the cylindrical engagement portion having sufficient flexibility to permit attachment and releasability of the pin retaining member as a cap-like member. Additionally, each of the herein described pin retaining member could be manufactured for threaded, tapering, interference or similar mechanical engagement.

As to operation of each of the preceding, a coaxial cable (not shown) having an extended center conductor can be brought into engagement with the cable guide 34, 34A in order to receive the step up pin 14, 14A and remove same from the center opening 288 of the pin retaining member 280. Since each herein described pin retaining member 260, 280, 300, 320 is releasably attached to the connector 10, 200, the pin retaining member can then be easily removed from the connector prior to final assembly. Assembly of the step pin 14, 14A and the coax cable proceeds generally in the same manner as that described in FIGS. 5C-5E and 9C-9E. The broadband connector 200 includes a different pin guide 259, as is shown in FIG. 26, but otherwise the assembly and use of the step up pin in relation to a coax cable and connector is very similar other than structural differences in the design of the pin guide and the coax cable/step up pin itself.

PARTS LIST FOR FIGS. 1-35

10 connector, coax cable
12 connector body
14 step up pin
14A step up pin
20 nut body
22 collar
24 compression ring
26 inner post
27 o-ring
28 pin guide
30 shaft
32 pin body
32A pin body
34 cable guide
34A cable guide
35 axial bore of pin body
36 spring fingers
37 open end of pin body
38 tabs
39 sidewall bore of compression ring
40 coax cable
42 central conductor
44 dielectric sleeve
46 outer conductor
48 jacket
50 sprue tabs
52 sprue tabs
54 surface of cable guide
56 surface of pin guide
124 alternate compression ring with countersunk sidewall bore
139 countersunk sidewall bore
160 recessed portion of the countersunk sidewall bore
164 bore
166 bore
170 bore
172 pin receptacle
176 bore, axial
180 ring-like component
184 radial projection
186 axial bore
200 cable connector
210 connector body
220 nut body
224 first end
230 collar or body section
232 first end
234 second end
235 center passageway
236 flanged portion
237 basket
238 axial slots
240 compression member
242 distal end
250 inner post
254 first end
255 shaft
256 second end
257 barbs
258 center passageway
259 pin guide
260 pin retaining member
262 body
264 cylindrical engagement portion
268 center opening
280 pin retaining member
282 body
284 cylindrical engagement portion
288 center opening
290 recess
300 pin retaining member
302 body
304 engagement portion
308 center opening
320 pin retaining member

322 body
324 engagement portion
328 center opening

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A coaxial cable connector, said connector comprising:
a body section having an axial bore disposed therethrough;
a coupler, rotatable with respect to the body section, each of said coupler and said body section being disposed along a center axis extending through said axial bore; and
a step up pin mounted for storage in relation to said center axis of said connector in a position that does not cross or intersect said center axis.

2. The coaxial cable connector of claim 1, wherein a portion of said connector includes a sidewall bore which is sized for storing at least a portion of said step up pin prior to use.

3. The coaxial cable connector of claim 2, wherein said sidewall bore includes a diameter sized to permit portion of said step up pin to pass therethrough, but not the entirety thereof.

4. The coaxial cable connector of claim 3, wherein said step up pin includes an upper portion having a diameter which is larger than the remainder of said pin.

5. The coaxial cable connector of claim 2, including a compression member attached to said body section oppositely from said coupler.

6. The coaxial cable connector of claim 5, wherein said portion of said connector having said sidewall bore is one of said body section, said coupler and said compression member.

7. The coaxial cable connector of claim 1, including a radial projection extending from an exterior surface of said connector, said radial projection including a bore sized for retaining at least a portion of said step up pin.

8. The coaxial cable connector of claim 7, wherein said radial projection is provided on a separate component element from the body section and the coupler.

9. The coaxial cable connector of claim 8, wherein said separate component element comprises a ring-like section.

* * * * *